US010911857B2

(12) United States Patent
Mihara et al.

(10) Patent No.: US 10,911,857 B2
(45) Date of Patent: Feb. 2, 2021

(54) SOUND OUTPUT APPARATUS

(71) Applicant: SONY CORPORATION, Tokyo (JP)

(72) Inventors: Ryota Mihara, Tokyo (JP); Yasuhide Hosoda, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/326,034

(22) PCT Filed: Jul. 12, 2017

(86) PCT No.: PCT/JP2017/025429
§ 371 (c)(1),
(2) Date: Feb. 15, 2019

(87) PCT Pub. No.: WO2018/042900
PCT Pub. Date: Mar. 8, 2018

(65) Prior Publication Data

US 2019/0174216 A1 Jun. 6, 2019

(30) Foreign Application Priority Data

Aug. 31, 2016 (JP) ..... 2016-169333
Jan. 27, 2017 (JP) ..... 2017-013705

(51) Int. Cl.
*H04R 1/10* (2006.01)
*H04R 25/00* (2006.01)
(Continued)

(52) U.S. Cl.
CPC ..... *H04R 1/1016* (2013.01); *H04R 1/06* (2013.01); *H04R 1/10* (2013.01); *H04R 1/105* (2013.01);
(Continued)

(58) Field of Classification Search
CPC ..... H04R 1/10; H04R 1/1016; H04R 1/105; H04R 1/1075; H04R 5/0335; H04R 25/02;
(Continued)

(56) References Cited

U.S. PATENT DOCUMENTS 5,975,235 A * 11/1999 Schlaegel ..... H04R 25/48 181/129
6,307,943 B1 10/2001 Yamagishi
(Continued)

FOREIGN PATENT DOCUMENTS

CA 2964710 5/2016
JP H03-117999 5/1991
(Continued)

OTHER PUBLICATIONS

International Search Report prepared by the Japan Patent Office dated Sep. 15, 2017, for International Application No. PCT/JP2017/025429.
(Continued)

*Primary Examiner* — Jesse A Elbin
(74) *Attorney, Agent, or Firm* — Sheridan Ross P.C.

(57) ABSTRACT

A stable wearing state on an ear is secured. A speaker that outputs sound; a speaker arrangement portion in which the speaker is arranged therein; and a sound guiding pipe in which one end portion is continuous with the speaker arrangement portion and an internal space is formed as a sound guiding space that leads the sound outputted from the speaker are provided, in which an opening that emits the sound toward an ear is formed at the other end of the sound guiding pipe. The sound output apparatus is worn on the ear by sandwiching the outer peripheral portion of the auricle between the sound guiding pipe and the speaker arrange-
(Continued)

ment portion or by the sound guiding pipe so that a stable wearing state on the ear can be secured.

13 Claims, 18 Drawing Sheets

(51) Int. Cl.
*H04R 1/06* (2006.01)
*H04R 5/033* (2006.01)
*H04R 25/02* (2006.01)

(52) U.S. Cl.
CPC ..... *H04R 1/1075* (2013.01); *H04R 5/0335* (2013.01); *H04R 25/652* (2013.01); *H04R 25/656* (2013.01); *H04R 25/02* (2013.01); *H04R 25/607* (2019.05); *H04R 2205/024* (2013.01); *H04R 2225/021* (2013.01); *H04R 2225/0213* (2019.05)

(58) Field of Classification Search
CPC .. H04R 25/607; H04R 25/652; H04R 25/656; H04R 2225/021; H04R 2225/0213; H04R 1/06; H04R 2205/024; H04R 2420/07; H04R 2460/09
USPC ..... 381/322, 324, 328, 330
See application file for complete search history.

(56) References Cited

U.S. PATENT DOCUMENTS

| | | | | |
|---|---|---|---|---|
| 8,625,834 | B2 * | 1/2014 | Smith | H04M 1/05 381/380 |
| 10,182,281 | B2 * | 1/2019 | Igarashi | H04R 1/1016 |
| 2004/0165743 | A1 * | 8/2004 | Bayer | H04R 25/65 381/330 |
| 2017/0087364 | A1 * | 3/2017 | Cartledge | A61N 1/00 |

FOREIGN PATENT DOCUMENTS

| | | | | |
|---|---|---|---|---|
| JP | 2004-208220 | | 7/2004 | |
| JP | 2012-134916 | | 7/2012 | |
| JP | 2013-115799 | | 6/2013 | |
| JP | 2014-096739 | | 5/2014 | |
| WO | WO 2016/067754 | | 5/2016 | |
| WO | WO-2016067700 | A1 * | 5/2016 | H04R 1/1016 |

OTHER PUBLICATIONS

Extended European Search Report for European Patent Application No. 17845910.3, dated Apr. 26, 2019, 10 pages.
Official Action (with English translation) for Chinese Patent Application No. 201780051159.8, dated Jan. 6, 2020, 17 pages.

* cited by examiner

SOUND OUTPUT APPARATUS

CROSS REFERENCE TO RELATED APPLICATIONS

This application is a national stage application under 35 U.S.C. 371 and claims the benefit of PCT Application No. PCT/JP2017/025429 having an international filing date of 12 Jul. 2017, which designated the United States, which PCT application claimed the benefit of Japanese Patent Application Nos. 2016-169333 filed 31 Aug. 2016 and 2017-013705 filed 27 Jan. 2017, the entire disclosures of each of which are incorporated herein by reference.

TECHNICAL FIELD

The present technology relates to a technical field of a sound output apparatus in which a speaker is arranged therein and which is used by being worn on an ear.

BACKGROUND ART

There is a sound output apparatus which is worn on a head to be used as a headphone or an earphone and outputs sound from a speaker.

In recent years, in addition to the mode of being used indoors, the mode of being used outdoors is also increased in the sound output apparatus. In a case where the sound output apparatus is used outdoors, it is desirable that sound outputted from the sound output apparatus and external sound both be audible to a user in consideration of the safety of not only the user but also pedestrians, drivers and the like existing around the user.

Various types of sound output apparatuses have been developed as types that make both sounds of the sound outputted from such a sound output apparatus and the external sound audible (e.g., see Patent Document 1 and Patent Document 2).

The sound output apparatus described in Patent Document 1 is configured such that a vibrating element as a driver for sound output is arranged inside a housing, vibration occurring at the vibrating element is transmitted to the ear bone existing around the external auditory canal and transmitted to the brain from the ear bone via the skull and the like, and sound recognition is performed.

In this sound output apparatus, a through hole penetrating the housing and the vibrator is formed, and external sound is transmitted to the user through the through hole without interrupting the vibration of the vibrator.

In the sound output apparatus described in Patent Document 2, a housing is constituted by an insertion portion and a transmission member, an electroacoustic conversion element and a vibrating body as drivers for sound output are arranged inside the transmission member, and a plug, which is movable in the inside and the outside of the insertion portion, is provided. A through hole that makes external sound audible is formed in the insertion portion.

This sound output apparatus is worn on an ear in a state where a part of the insertion portion is inserted into the external auditory canal, and the transmission member is in contact with the tragus and the antitragus at the front of the insertion portion. The vibration occurring at the electroacoustic conversion element is transmitted from the vibrating body to the transmission member, the transmitted vibration is transmitted to the brain from the ear bone via the skull and the like, and sound recognition is performed. The external sound vibrates to the space between the plug and the eardrum and is transmitted to the user. At this time, it is possible to change the manner in which the external sound is heard by moving the plug.

CITATION LIST

Patent Document

Patent Document 1: Japanese Patent Application Laid-Open No. 2004-208220

Patent Document 2: Japanese Patent Application Laid-Open No. 2014-96739

SUMMARY OF THE INVENTION

Problems to be Solved by the Invention

Incidentally, since the sound output apparatus described in Patent Document 1 is axially formed and used in a state of being inserted into the external auditory canal, there is a possibility that the sound output apparatus falls off from the ear in a case where the user moves greatly, or the like.

On the other hand, the sound output apparatus described in Patent Document 2 has a portion, which is axially formed and inserted into the external auditory canal, and a hook member, which is formed in a substantially semicircular arc shape and worn on the root portion of the auricle. Compared with the sound output apparatus described in Patent Document 1, the stability of the wearing state is enhanced by having the hook member.

However, since the hook member is in a state of being hooked on the root portion of the auricle from above, particularly for a long-haired user such as a woman, the hair interferes with the hook member, making it difficult to hook the hook member on the root portion of the auricle. Thus, there is a possibility that sufficient stability of the wearing state cannot be secured.

Thereupon, the sound output apparatus of the present technology overcomes the problems described above and aims to secure a stable wearing state on the ear.

Solutions to Problems

Firstly, a sound output apparatus according to the present technology includes: a speaker that outputs sound; a speaker arrangement portion in which the speaker is arranged therein; and a sound guiding pipe in which one end portion is continuous with the speaker arrangement portion and an internal space is formed as a sound guiding space that leads the sound outputted from the speaker, in which an opening that emits the sound toward an ear is formed at the other end of the sound guiding pipe, and the sound output apparatus is worn on the ear in a state where an outer peripheral portion of an auricle is sandwiched between a part of the speaker arrangement portion and a part of the sound guiding pipe or between respective parts of the sound guiding pipe.

Accordingly, the sound output apparatus is worn on the ear by sandwiching the outer peripheral portion of the auricle between the sound guiding pipe and the speaker arrangement portion or by the sound guiding pipe.

Secondly, in the sound output apparatus described above, it is desirable that the opening be positioned at an inner space of the auricle.

Accordingly, the opening is positioned close to the external auditory canal.

Thirdly, in the sound output apparatus described above, it is desirable that the opening be positioned at a cavum concha.

Accordingly, the opening is positioned close to the external auditory canal.

Fourthly, in the sound output apparatus described above, it is desirable that the part of the sound guiding pipe be formed as an ear contact face in contact with the auricle, and the ear contact face be formed in a curved shape.

Accordingly, the ear contact face formed in a curved shape is brought into a state of being in contact with the auricle, and an excessive load is not applied to the auricle from the sound guiding pipe.

Fifthly, in the sound output apparatus described above, it is desirable that the part of the speaker arrangement portion be formed as an abutting face that can be in contact with the auricle, and the abutting face be formed in a planar shape.

Accordingly, the abutting face formed in a planar shape is brought into a state of being in contact with the auricle, and an excessive load is not applied to the auricle from the sound guiding pipe.

Sixthly, in the sound output apparatus described above, it is desirable that the sound guiding pipe be provided with a coupling base portion, which is continuous with the speaker arrangement portion, and a detachable portion, which is detachable from the coupling base portion and has the opening.

Accordingly, the portion having the opening of the sound guiding pipe can be replaced according to the size, shape and the like of the ear.

Seventhly, in the sound output apparatus described above, it is desirable that the coupling base portion be provided with an entry portion that enters the detachable portion when the detachable portion is attached to the coupling base portion.

Accordingly, the detachable portion is attached to the coupling base portion by the entry portion entering the detachable portion.

Eighthly, in the sound output apparatus described above, it is desirable that the detachable portion be formed by using a material with hardness lower than that of the coupling base portion.

Accordingly, a load on the auricle is small when the detachable portion comes into contact with the auricle by any chance.

Ninthly, in the sound output apparatus described above, it is desirable that the sound guiding pipe be elastically deformable against the speaker arrangement portion.

Accordingly, the sound guiding pipe is elastically deformed against the speaker arrangement portion so that the sound output apparatus can be worn on the ear.

Tenthly, in the sound output apparatus described above, it is desirable that a tip portion of the sound guiding pipe be in a state of being non-contact with the ear in a state of being worn on the ear.

Accordingly, the portion having the opening from which the sound is emitted is brought into a state of being not in contact with the ear.

Eleventhly, in the sound output apparatus described above, it is desirable that at least a part of the speaker arrangement portion and at least a part of the sound guiding pipe be integrally formed.

Accordingly, a portion in which the speaker arrangement portion and the sound guiding pipe are integrally formed exists in the sound output apparatus.

Twelfthly, in the sound output apparatus described above, it is desirable that a pair of the speaker arrangement portions, a pair of the sound guiding pipes and a pair of the speakers be provided.

Accordingly, the sound output apparatus functions as a stereo type.

Thirteenthly, in the sound output apparatus described above, it is desirable that a battery that supplies power to the speaker be arranged at the speaker arrangement portion.

Accordingly, there is no need to supply power from an external device.

Fourteenthly, in the sound output apparatus described above, it is desirable that a control board for wireless communication be arranged at the speaker arrangement portion.

Accordingly, there is no need of connection to an external device by a cord.

Fifteenthly, in the sound output apparatus described above, it is desirable that a first pressing portion and a second pressing portion, which are respectively pressed against both faces of the auricle, be provided, and the first pressing portion and the second pressing portion be elastically deformable in a direction in which the first pressing portion and the second pressing portion are brought into or out of contact with each other.

Accordingly, a wear portion is elastically deformed when worn on or detached from the ear.

Sixteenthly, in the sound output apparatus described above, it is desirable that a wear portion, which is bent such that a longitudinal direction becomes a circumferential direction, be provided, and the first pressing portion and the second pressing portion be provided at both end portions of the wear portion in the longitudinal direction.

Accordingly, both end portions of the wear portion are respectively pressed against both faces of the auricle in a state of being elastically deformed.

Effects of the Invention

According to the present technology, since the sound output apparatus is worn on the ear by sandwiching the outer peripheral portion of the auricle between the sound guiding pipe and the speaker arrangement portion or by the sound guiding pipe, a stable wearing state on the ear can be secured.

Note that the effects described in this specification are merely examples and are not limited, and other effects may be exerted.

MODE FOR CARRYING OUT THE INVENTION

Hereinafter, modes for carrying out a sound output apparatus of the present technology will be described according to the accompanying drawings.

In the embodiments shown below, the sound output apparatus of the present technology is applied to an earphone. However, the scope of application of the present technology is not limited to the earphone, and the present technology can be widely applied to various other sound output apparatuses such as a headphone.

<Structure of Ear>

Figure 1:
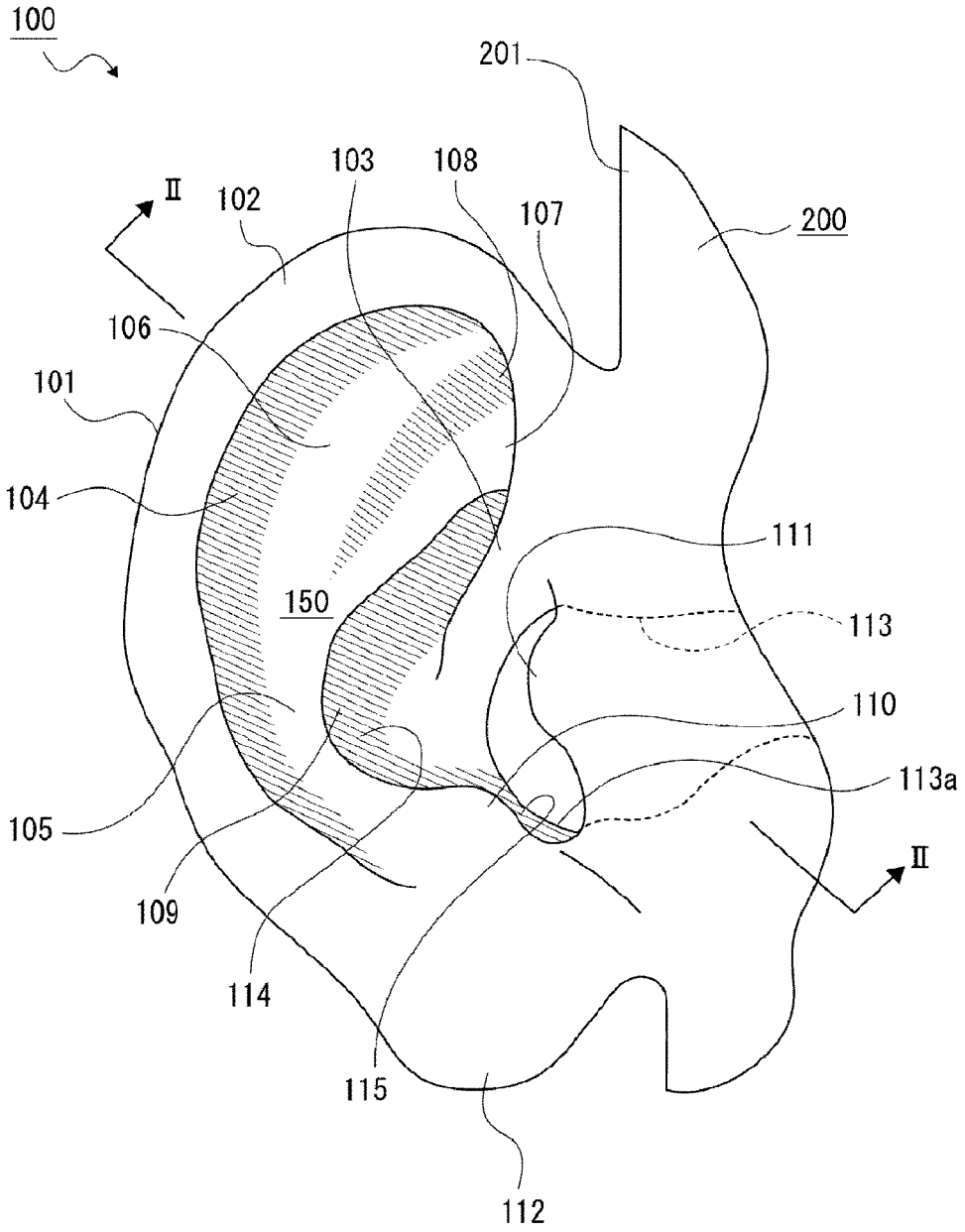
FIG. 1 shows embodiments of sound output apparatuses of the present technology together with FIGS. 2 to 19 and is a perspective view of an ear on which the sound output apparatuses are worn.
Figure 2:
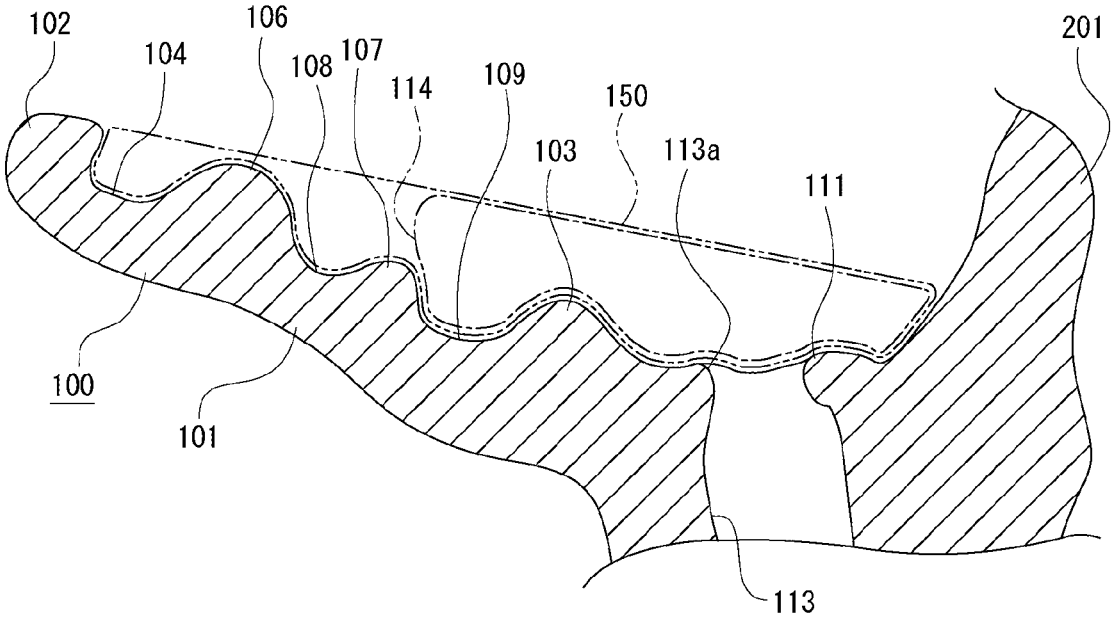
FIG. 2 is a sectional view along the line II-II in FIG. 1.

First, the structure of the ear on which the sound output apparatus is worn will be described (see FIGS. 1 and 2).

Ears 100 and 100 are parts of a head 200, each includes an auricle 101 and each part existing inside the head 200, such as an eardrum, semicircular canals, and a cochlea. Respective parts of the head 200 at the inner sides of the auricles 101 are temporal regions 201 and 201, and the auricles 101 project leftward or rightward from the temporal regions 201 and 201.

The auricle 101 has a shallow concave shape opened substantially forward as a whole so as to have an inner space 150, and the outer peripheral portion has a part called a helix 102 and a part called a crus of helix 103 which is continuous with the helix 102 and positioned in the vicinity of the temporal region 201.

The inner part of the helix 102 is called a concave scapha 104, and a substantially lower half of the inner side of the scapha 104 is called a convex antihelix 105. A bifurcated convex part which is continuous with the antihelix 105 exists above the antihelix 105, and the outer part and the inner part of the bifurcated part are called a superior crus of antihelix 106 and an inferior crus of antihelix 107, respectively. The part between the superior crus of antihelix 106 and the inferior crus of antihelix 107 is called a concave triangular fossa 108, and the inner part of the antihelix 105 and the inferior crus of antihelix 107 is called a concave cymba concha 109.

A part continuous with the lower side of the antihelix 105 is a part slightly bulging toward the side of the temporal region 201 and is called an antitragus 110. A part on the side of the temporal region 201 opposing the antitragus 110 is called a tragus 111 slightly bulging toward the side of the antitragus 110, and the lower end part continuous with the lower side of the helix 102 is called an earlobe 112.

An external auditory pore 113*a*, which is the entrance of an external auditory canal 113, exists between the antitragus 110 and the tragus 111, and the external auditory canal 113 communicates with the eardrum, the semicircular canals, and the like. Of the inner space 150 of the auricle 101, the space surrounded by the antihelix 105, the inferior crus of antihelix 107 and the crus of helix 103, in other words, the space on the front side of the cymba concha 109 is called a cavum concha 114 and communicates with the external auditory pore 113*a* of the external auditory canal 113. Of the inner space 150, the space continuous with the lower side of the cavum concha 114 and opened in a U-shape is a space called an intertragic notch 115.

The inner space 150 of the auricle 101 is a space which includes the space near the cavum concha 114, the intertragic notch 115 and the external auditory pore 113*a* of the external auditory canal 113 and also includes the space at the front side of the scapha 104, the antihelix 105, the superior crus of antihelix 106, the inferior crus of antihelix 107, the triangular fossa 108, the antitragus 110 and the tragus 111.

<Schematic Configuration of Sound Output Apparatus>

Figure 3:
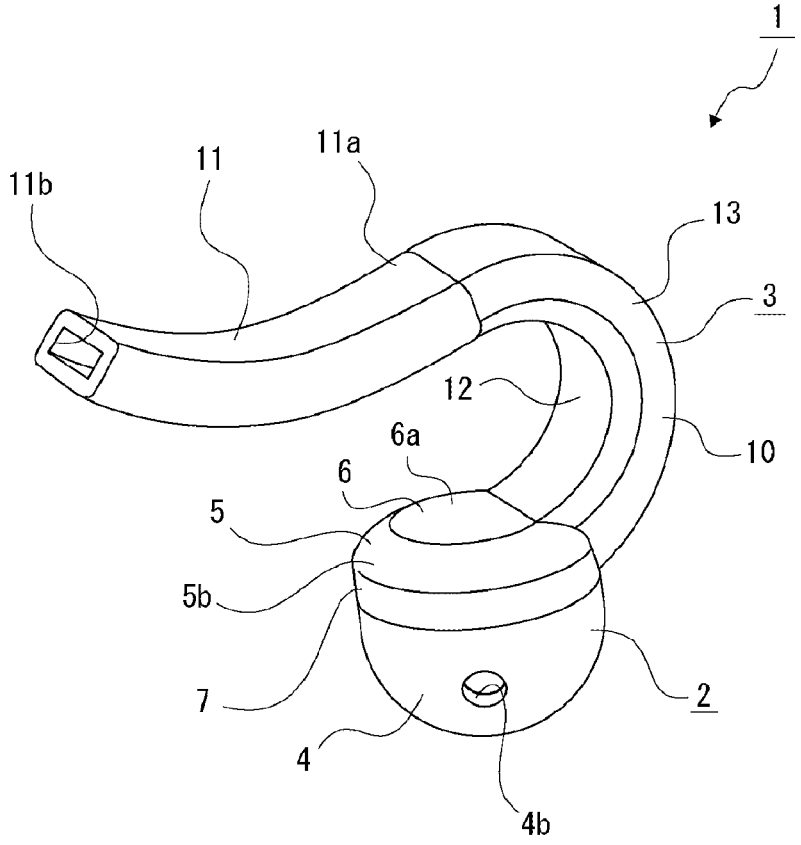
FIG. 3 is a perspective view of the sound output apparatus.
Figure 4:
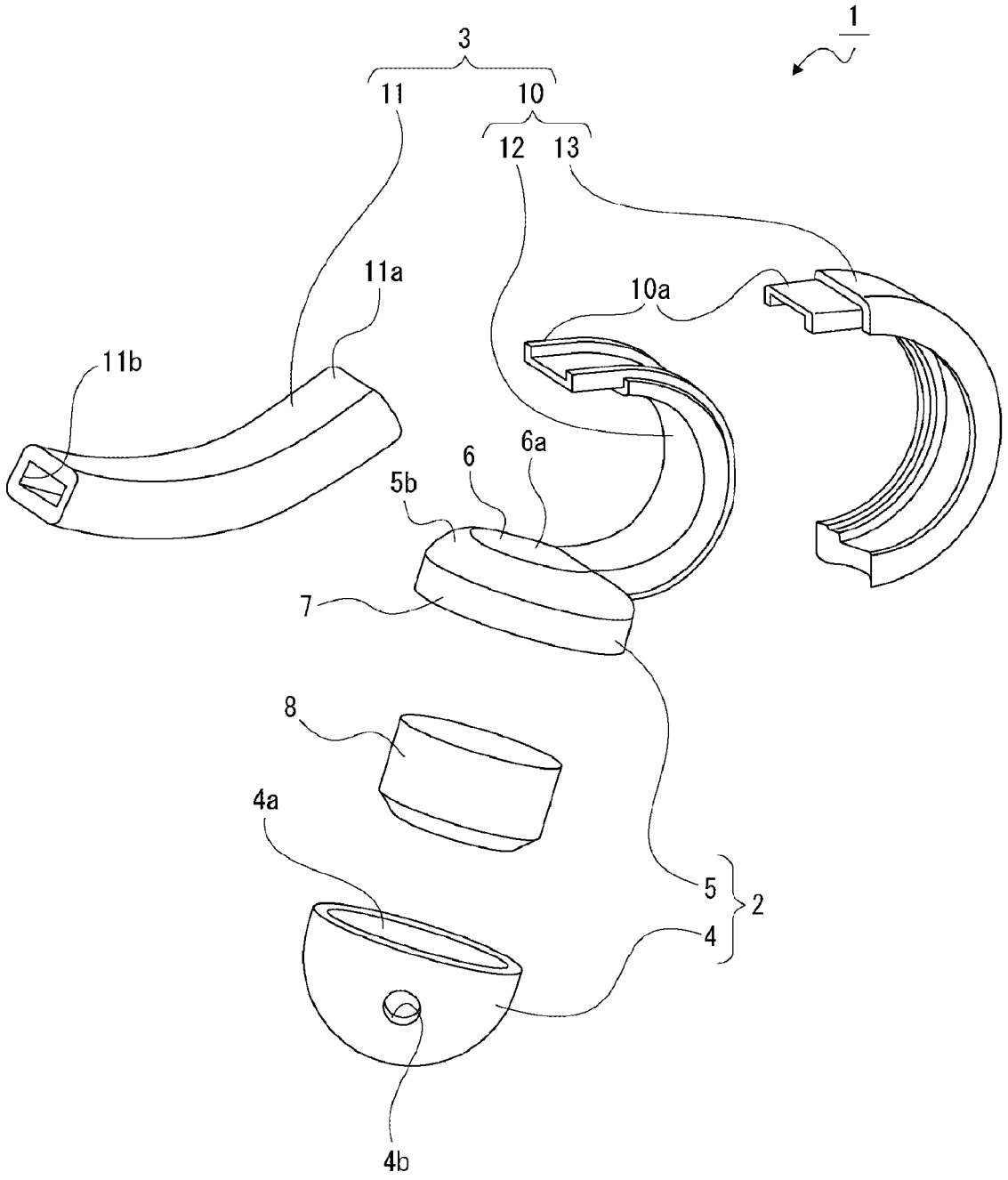
FIG. 4 is an exploded perspective view of the sound output apparatus.
Figure 5:
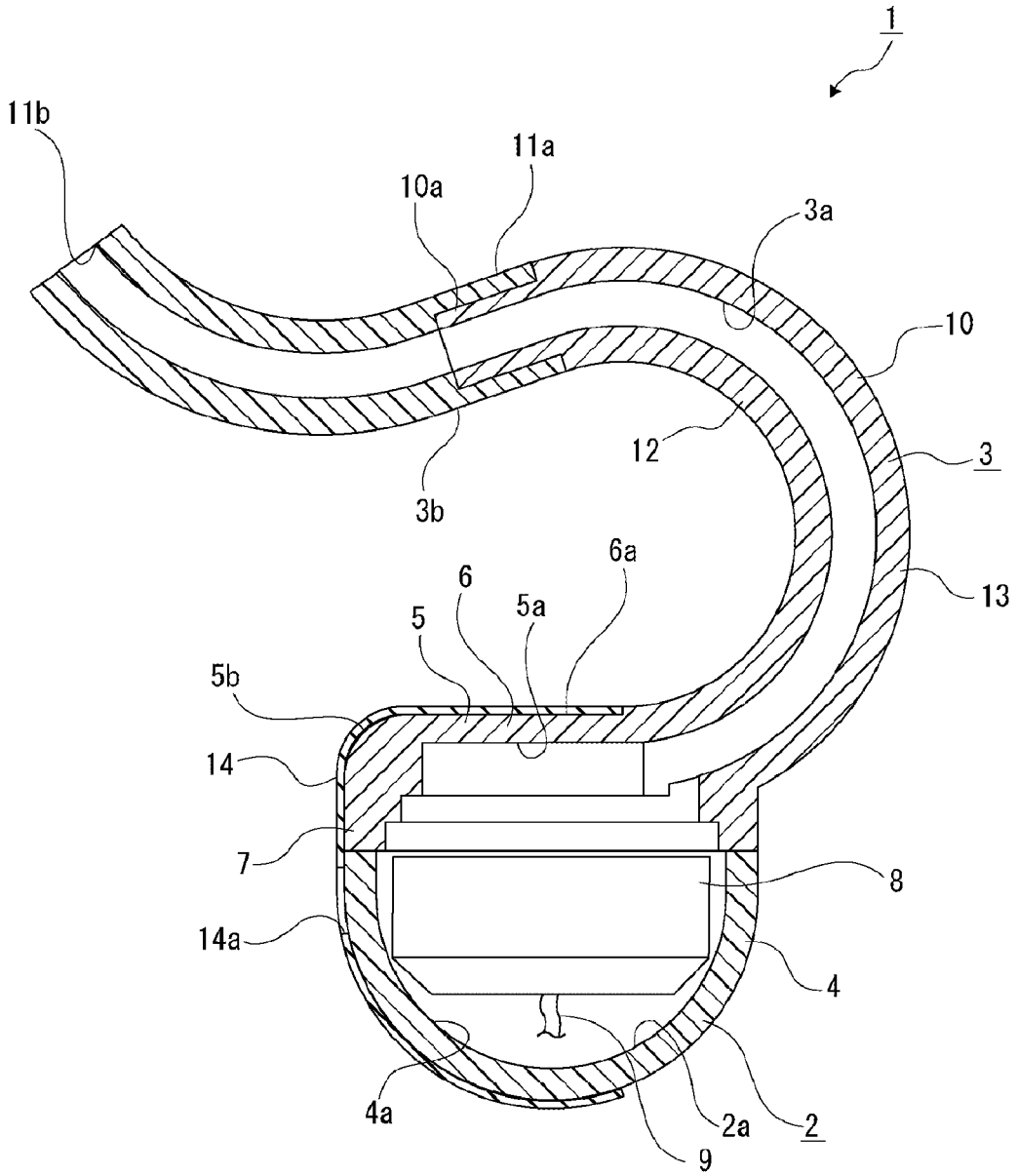
FIG. 5 is a sectional view of the sound output apparatus.

Next, the configuration of sound output apparatuses 1 and 1 will be described (see FIGS. 3 to 5). One of the sound output apparatuses 1 and 1 is used for the left ear 100, and the other is used for the right ear 100. However, any one of the sound output apparatuses 1 may be used to hear to the sound.

The sound output apparatus 1 has a speaker arrangement portion 2 and a sound guiding pipe 3.

The speaker arrangement portion 2 is constituted coupling a case portion 4 and a cover portion 5.

For example, the case portion 4 is formed in a substantially hemispherical shape with a resin material, and an internal space is formed as a case side concave portion 4*a*. A cord insertion hole 4*b* is formed in the case portion 4.

For example, the cover portion 5 is formed in a shallow bowl shape with a resin material, and an internal space is formed as a cover side recess portion 5*a*. The cover portion 5 includes a disk-shaped base face portion 6 and a cylindrical coupling portion 7 projecting from the outer peripheral portion of the base face portion 6. A continuous portion of the base face portion 6 and the coupling portion 7 is formed in a curved shape that is gently convex outward. The outer face (surface) of the base face portion 6 is formed as a planar abutting face 6*a*, and the outer face at the continuous portion of the base face portion 6 and the coupling portion 7 is formed as a curved face 5*b* that is convex outward.

The case portion 4 and the cover portion 5 are coupled in a state where the case side concave portion 4*a* and the cover side recess portion 5*a* face each other. The speaker arrangement portion 2 is constituted by coupling the case portion 4 and the cover portion 5, and an arrangement space 2*a* is formed inside the speaker arrangement portion 2.

A speaker 8 is arranged in the arrangement space 2*a* of the speaker arrangement portion 2. As the speaker 8, for example, a dynamic type driver unit is used. One end portion of a cord 9 is connected to the speaker 8, and the cord 9 is led out to the outside from the cord insertion hole 4*b* of the case portion 4. For example, a remote control apparatus (not shown) is connected to an intermediate portion of the cord 9 so that it is possible to change the type of sound outputted from the speaker 8, change the volume, and the like by manipulating the remote control apparatus.

Note that the cord 9 led out from the sound output apparatus 1 for the left ear 100 and the cord 9 led out from the sound output apparatus 1 for the right ear 100 both have the intermediate portions connected to the same remote control apparatus.

The other end portion of the cord 9 is connected to an external device (not shown), such as a music player, used as a generation source of sound (audio signal). Therefore, the audio signal outputted from the external device is transmitted to the speaker 8 via the cord 9, and the sound is outputted from the speaker 8. Moreover, power is supplied to the speaker 8 from the external device via the cord 9 so that the speaker 8 can be driven.

The sound guiding pipe 3 is constituted by a coupling base portion 10 and a detachable portion 11. The sound guiding pipe 3 is formed in a flat substantially square tube shape, and an internal space is formed as a sound guiding space 3*a*. The sound guiding space 3*a* communicates with the arrangement space 2*a* of the speaker arrangement portion 2.

For example, the coupling base portion 10 is formed by using a resin material and constituted by coupling a first half 12 and a second half 13. The coupling base portion 10 is formed in a substantially semicircular arc shape, in which the first half 12 is positioned on the inner peripheral side, and the second half 13 is positioned on the outer peripheral side. For example, in the coupling base portion 10, the first half 12 is integrally formed with the cover portion 5 of the speaker arrangement portion 2, and one end of the first half 12 in the longitudinal direction is continuous with the curved face 5*b* of the cover portion 5.

Note that the coupling base portion 10 may have the second half 13 integrally formed with the cover portion 5 or may be integrally formed with the cover portion 5 as a whole. Moreover, at least a part of the coupling base portion 10 may be integrally formed with the cover portion 5.

By thus integrally forming at least a part of the speaker arrangement portion 2 and at least a part of the sound guiding pipe 3, a portion, in which the speaker arrangement portion 2 and the sound guiding pipe 3 are integrally formed, exists in the sound output apparatus 1 so that it is possible to improve the strengths of the speaker arrangement portion 2 and the sound guiding pipe 3 and to reduce the number of parts of the sound output apparatus 1.

The coupling base portion 10 is provided with an entry portion 10*a* at the end portion on the side opposite to the side continuous with the cover portion 5 in the longitudinal direction. The entry portion 10*a* is formed in a cylindrical shape smaller than other portions of the coupling base portion 10.

The detachable portion 11 is formed by using a material with hardness lower than that of the coupling base portion 10, for example, a rubber material such as elastomer, and is formed in a substantially square tube shape that is gently curved. The detachable portion 11 has the inner circumference of one end portion in the longitudinal direction slightly longer in diameter than the inner circumferences of other portions, and this one end portion is provided as a joining portion 11*a*. The detachable portion 11 is detachable from the coupling base portion 10 and coupled to the coupling base portion 10 by externally fitting the joining portion 11*a* to the entry portion 10*a*. An opening 11*b* at the end on the side opposite to the joining portion 11*a* of the detachable portion 11 is formed as a sound output port from which the sound emitted from the speaker 8 and guided to the sound guiding space 3*a* is outputted.

In a state where the detachable portion 11 is coupled to the coupling base portion 10, the detachable Portion 11 is brought into a convex curved state toward the side of the speaker arrangement portion 2.

The sound guiding pipe 3 has a part of the face, which faces the side of the speaker arrangement portion 2, formed as an ear contact face 3*b* which is brought into contact with the auricle 101, and the ear contact face 3*b* is formed in a curved shape. The ear contact face 3*b* may be a part of the coupling base portion 10, may be a part of the detachable portion 11, or may be a portion extending over the coupling base portion 10 and the detachable portion 11.

The sound guiding pipe 3 is elastically deformable in a direction in which the ear contact face 3*b* is brought into or out of contact with the speaker arrangement portion 2 with respect to the speaker arrangement portion 2.

Note that the example, in which the sound guiding pipe 3 is constituted by the coupling base portion 10 and the detachable portion 11, has been shown above, but the sound guiding pipe may be constituted only by the coupling base portion. In this case, the opening at the tip of the coupling base portion is formed as a sound output port.

<Wearing State of Sound Output Apparatus on Ear>

Hereinafter, a wearing state of the sound output apparatus 1 on the ear 100 will be described (see FIGS. 6 to 9).

Figure 6:
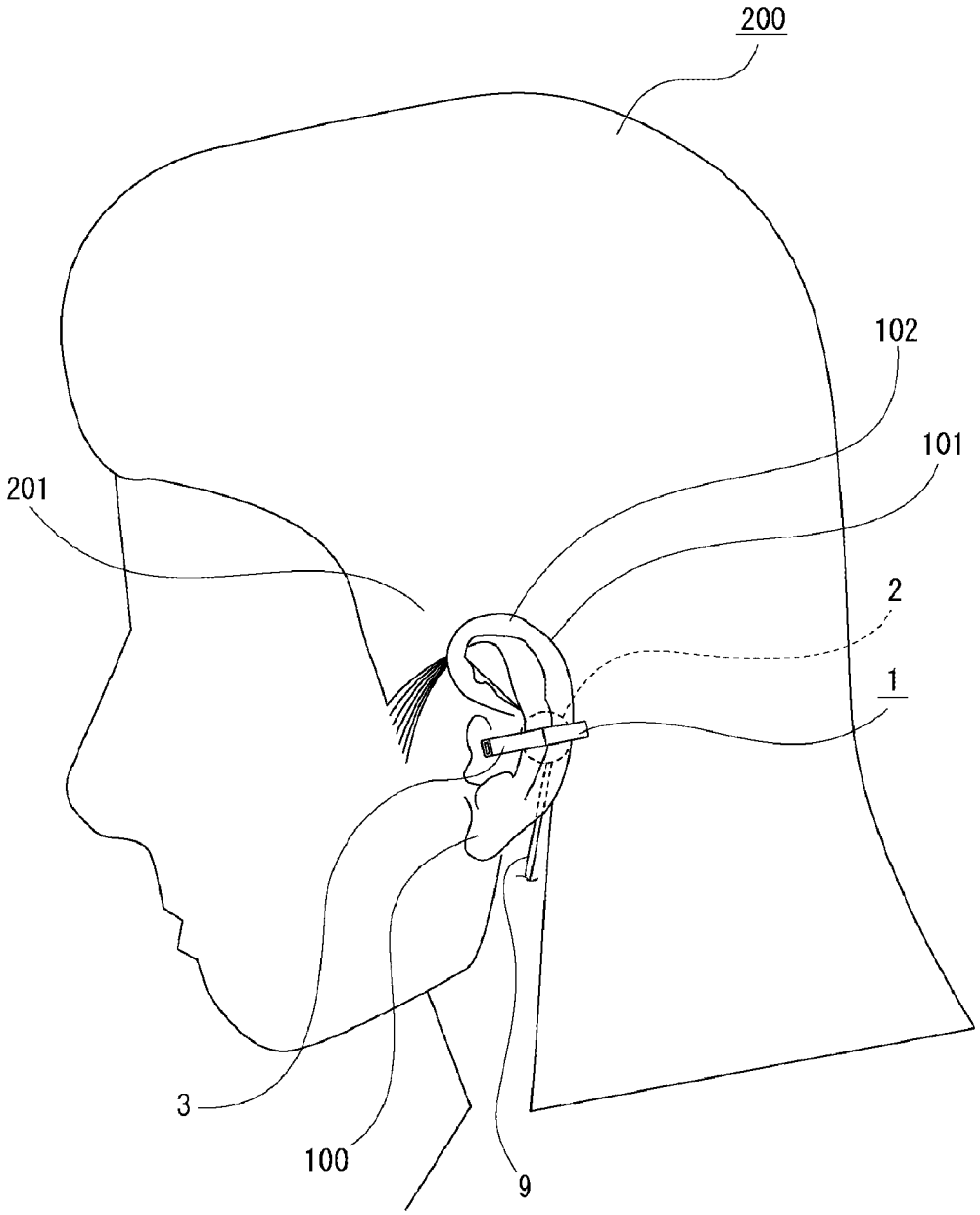
FIG. 6 is a perspective view showing a state where the sound output apparatus is worn on the ear.
Figure 7:
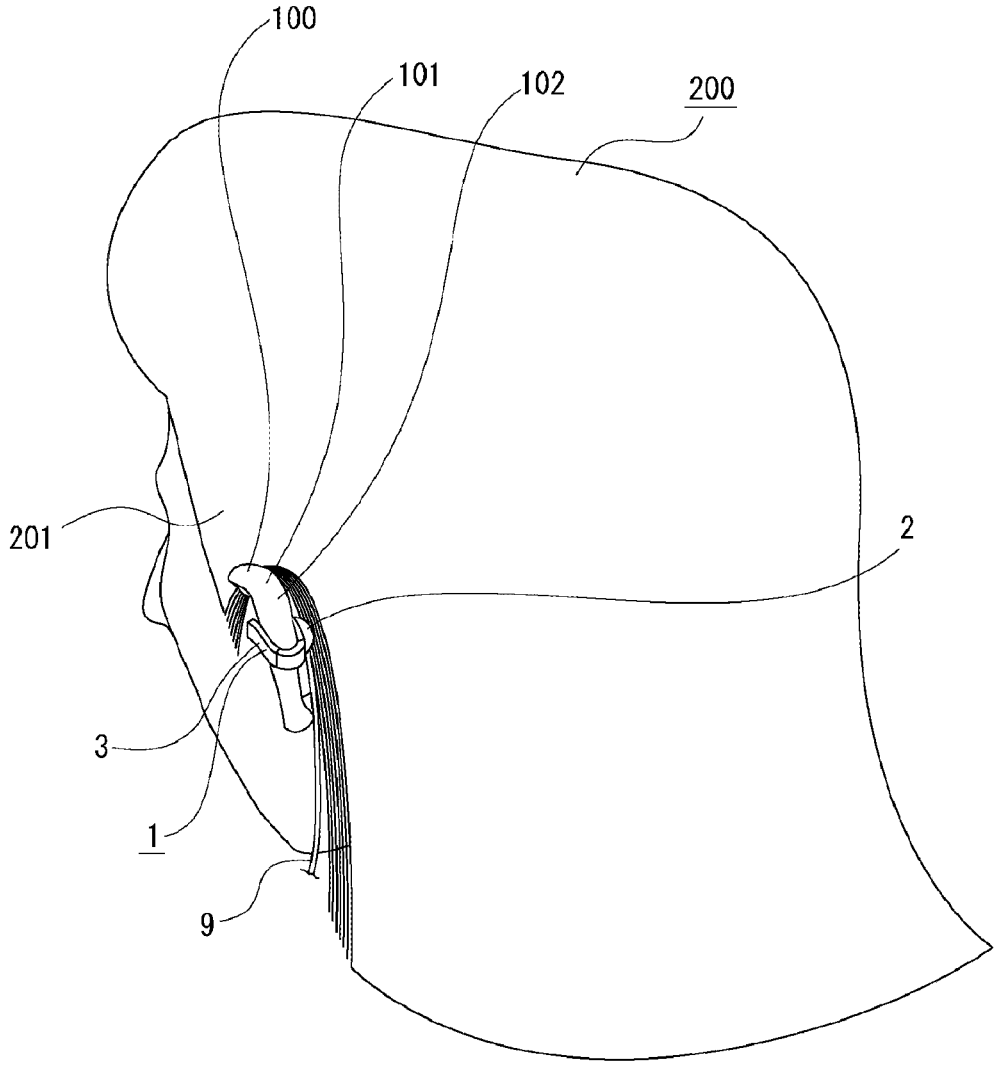
FIG. 7 is a perspective view showing the state where the sound output apparatus is worn on the ear as seen from an angle different from that in FIG. 6.

The sound output apparatus 1 is worn on the ear 100 in a state where the outer peripheral portion of the auricle 101, for example, the helix 102 is sandwiched from the front and back by a part of the speaker arrangement portion 2 and a part of the sound guiding pipe 3 (see FIGS. 6 and 7). In a state where the sound output apparatus 1 is worn on the ear 100, the abutting face 6*a* of the speaker arrangement portion 2 and the ear contact face 3*b* of the sound guiding pipe 3 are in contact with the ear 100.

At this time, since the ear contact face 3*b* of the sound guiding pipe 3 is formed in a curved shape, the ear contact face 3*b* formed in a curved shape is brought into a state of being in contact with the auricle 101, and an excessive load is not applied to the auricle 101 from the sound guiding pipe 3. Thus, it is possible to secure a good wearing state of the sound output apparatus 1 on the auricle 101.

Moreover, since the abutting face 6*a* of the speaker arrangement portion 2 is formed in a planar shape, the abutting face 6*a* formed in a planar shape is brought into a state of being in contact with the auricle 101, and an excessive load is not applied to the auricle 101 from the sound guiding pipe 3. Thus, it is possible to secure a good wearing state of the sound output apparatus 1 on the auricle 101.

Note that the example, in which the ear contact face 3*b* is formed in a curved shape and the abutting face 6*a* is formed in a planar shape, has been shown above, but the ear contact face may be formed in a planar shape, and the abutting face may be formed in a curved shape.

Since the sound guiding pipe 3 is elastically deformable against the speaker arrangement portion 2 in the sound output apparatus 1, when the sound output apparatus 1 is worn on the ear 100, the sound output apparatus 1 can be worn on the ear 100 in a state where the sound guiding pipe 3 is elastically deformed against the speaker arrangement portion 2 to enlarge the gap between the abutting face 6*a* of the speaker arrangement portion 2 and the ear contact face 3*b* of the sound guiding pipe 3. Thus, the sound output apparatus 1 can be easily worn on the ear 100.

Moreover, the sound output apparatus 1 is worn on the ear 100 in a state where the gap between the abutting face 6*a* and the ear contact face 3*b* is enlarged further by elastically deforming the sound guiding pipe 3 against the speaker arrangement portion 2 than the gap in a state before the sound output apparatus 1 is worn on the ear 100.

Therefore, since a force is applied to the speaker arrangement portion 2 and the sound guiding pipe 3 in a direction they approach each other, the sound output apparatus 1 is worn on the ear 100 in a state where the speaker arrangement portion 2 and the sound guiding pipe 3 are pressed against the auricle 101, and the sound output apparatus 1 can be worn on the ear 100 in a stable state.

Figure 8:
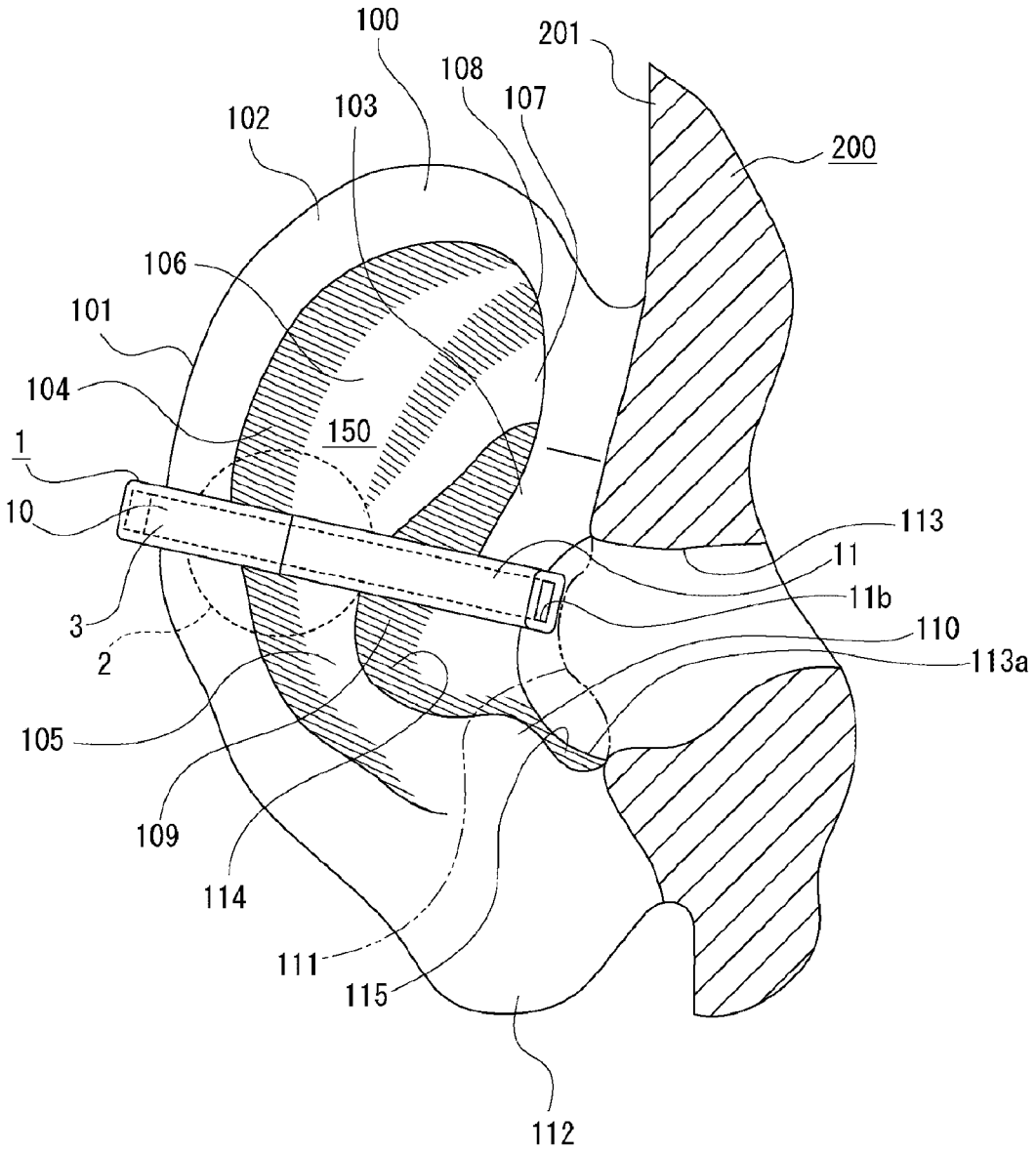
FIG. 8 is a front view showing a partial cross-section of a state where the sound output apparatus is worn on the ear and the opening of the sound guiding pipe is positioned near the external auditory pore.

In a state where the sound output apparatus 1 is worn on the ear 100 as described above, the detachable portion 11 is positioned at the inner space 150 of the auricle 101 in a state where the tip portion is in non-contact with the auricle 101 (see FIG. 8). The detachable portion 11 is brought into a state not closing the entire external auditory pore 113*a*, and the opening 11*b* is positioned near the external auditory pore 113*a*.

Since the opening 11*b* of the sound guiding pipe 3 is positioned at the inner space 150 of the auricle 101 in this way in a state where the sound output apparatus 1 is worn on the ear 100, the opening 11*b* is positioned close to the external auditory canal 113. Thus, it is possible to secure good recognition of the sound outputted from the speaker 8 and the external sound.

Furthermore, since the portion having the opening 11*b* of the sound guiding pipe 3 is brought into a state of being non-contact with the ear 100 in a state where the sound output apparatus 1 is worn on the ear 100, the portion having the opening 11*b* from which the sound is emitted is brought into a state of being not contact with the ear 100.

Therefore, it is possible to secure good recognition of the sound outputted from the sound output apparatus 1 and the external sound as well as possible to reduce the occurrence of discomfort in the wearing state on the ear 100.

Further, since the opening 11*b* is positioned near the external auditory canal 113*a* in a state where the sound output apparatus 1 is worn on the ear 100, the sound guided by the sound guiding pipe 3 is emitted toward the external auditory pore 113 from the opening 11*b*, the sound can be heard well.

Figure 9:
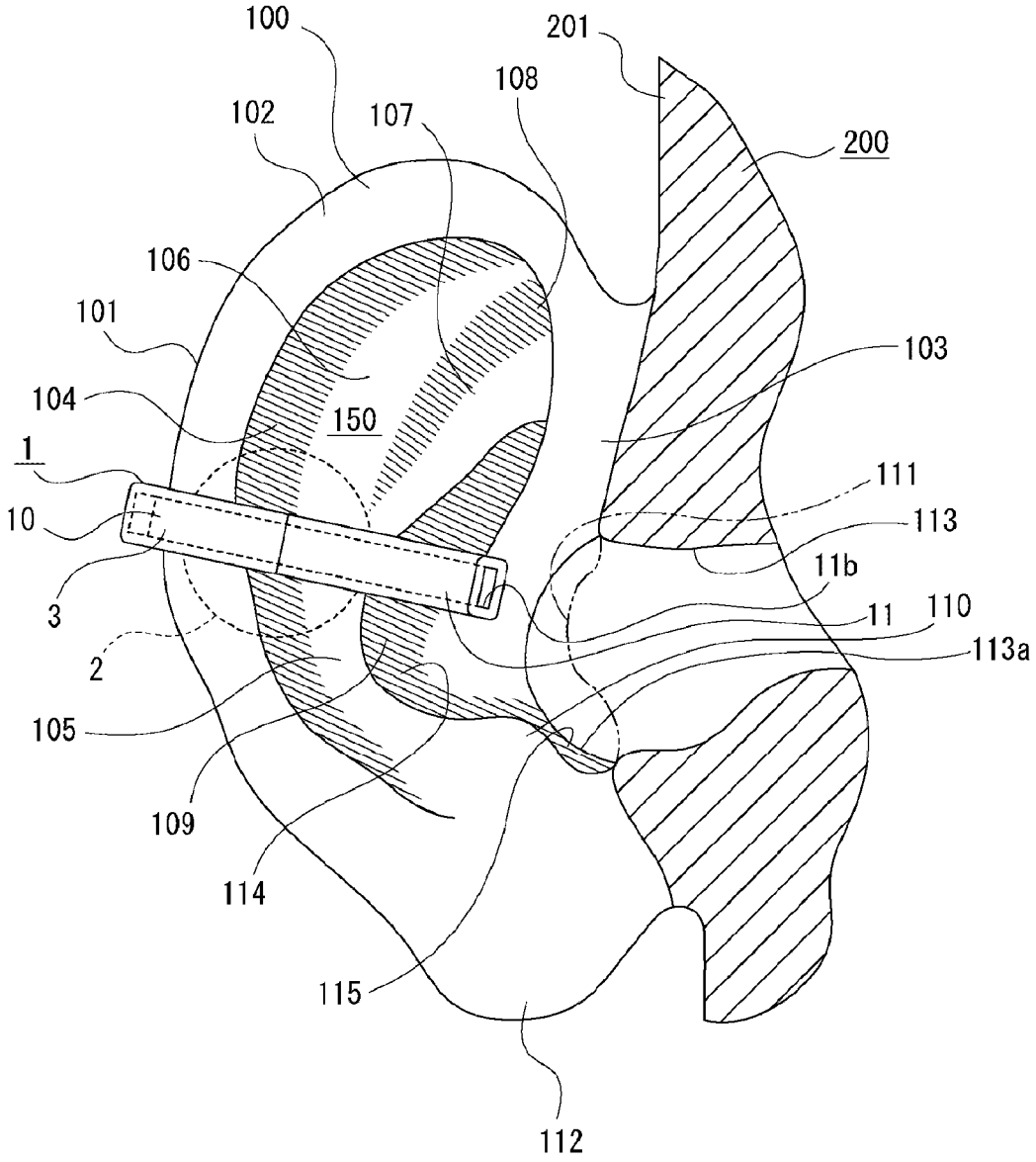
FIG. 9 is a front view showing a partial cross-section of a state where the sound output apparatus is worn on the ear and the opening of the sound guiding pipe is positioned at the cavum concha.

Note that the opening 11*b* of the sound guiding pipe 3 may be positioned at the cavum concha 114 in a state where the sound output apparatus 1 is worn on the ear 100 (see FIG. 9).

Since the opening 11*b* of the sound guiding pipe 3 is positioned close to the external auditory canal 113 also in this case, it is possible to secure good recognition of the sound outputted from the speaker 8 and the external sound.

In addition, the opening 11*b* of the detachable portion 11 may not be positioned at the external auditory canal 113 or the cavum concha 114, and may be positioned away from the external auditory canal 113 and the cavum concha 114 as long as the opening 11*b* is positioned at the inner space 150 of the auricle 101.

Note that the opening 11*b* of the detachable portion 11 may be positioned at the outer side of the inner space 150 of the auricle 101 depending on the shape and size of the ear 100 of a user.

Since no structural object, such as the speaker 8 arranged inside the speaker arrangement portion 2, exists on the front side of the auricle 101 in a state where the sound output apparatus 1 is worn on the ear 100, the structural object existing on the front side of the auricle 101 is small, and the influence on the head-related transfer function is suppressed. Thus, it is possible to suppress the reduction of the space perception ability.

Moreover, the portion having the opening 11*b* of the sound guiding pipe 3 is provided as the detachable portion 11 detachable from the coupling base portion 10 of the sound guiding pipe 3. Therefore, the portion having the opening 11*b* of the sound guiding pipe 3 can be replaced according to the size, shape and the like of the ear 100, and it is possible to secure a good hearing state of the sound regardless of the size, shape and the like of the ear 100.

For example, by replacing the detachable portion 11 with one with a different length, the opening 11*b* can be positioned at a desired position in a state where the sound output apparatus 1 is worn on the ear 100, and the usability of the sound output apparatus 1 can be improved.

Furthermore, since the coupling base portion 10 is provided with the entry portion 10*a* which enters the detachable portion 11 upon the attachment of the detachable portion 11, the detachable portion 11 is attached to the coupling base portion 10 by the entry portion 10*a* entering the detachable portion 11 so that it is possible to quickly and easily perform the attachment work of the detachable portion 11 to the coupling base portion 10.

Further, since the detachable portion 11 is formed by using a material with hardness lower than that of the coupling base portion 10, a load on the auricle 101 is small when the detachable portion 11 comes into contact with the auricle 101 by any chance, and the auricle 101 can be protected.

Note that the detachable portion 11 may be formed by using a material (flexible material) which is capable of being deformed (bent) and maintains the deformed state. By making the detachable portion 11 of such a material, it is possible to, in a state where the sound output apparatus 1 is worn on the ear 100, deform the detachable portion 11 into a desired state, for example, to make the opening 11*b* close to the external auditory canal 113 and change the direction of the sound emitted from the opening 11*b* as necessary.

Moreover, both of the coupling base portion 10 and the detachable portion 11 may be formed by using a material which is capable of being deformed (bent) and maintains the deformed states. By making the coupling base portion 10 and the detachable portion 11 of such a material, it is possible to, in a state where the sound output apparatus 1 is worn on the ear 100, deform the sound guiding pipe 3 into a desired state, for example, to make the opening 11*b* close to the external auditory canal 113 and change the direction of the sound emitted from the opening 11*b* as necessary.

Furthermore, when the sound guiding pipe 3 is worn on the ear 100, the sound guiding pipe 3 can be deformed according to the shape and size of the ear 100 so that a stable wearing state of the sound output apparatus 1 on the ear 100 can be secured.

In addition, in a case where the pair of sound output apparatuses 1 and 1 is used, the sound output apparatuses 1 and 1 function as a stereo type, the functionality of the sound output apparatuses 1 and 1 is improved, and good quality sound can be heard. Moreover, a good balance in weight is secured for the left and right ears 100 and 100, and the sound output apparatuses 1 and 1 can be worn on the left and right ears 100 and 100 in a stable state.

Note that there is a possibility that the speaker arrangement portion 2 and the sound guiding pipe 3 cannot sandwich the auricle 101 with sufficient pressure depending on the shape and thickness of the ear 100 of the user in a state where the sound output apparatus 1 is worn. In this case, for example, it is also possible to attach an auxiliary cover 14 to a part of the speaker arrangement portion 2 for use (see FIG. 5).

The auxiliary cover 14 is formed by using, for example, a rubber material such as elastomer, and is made to be stretchable and have high adhesion to the speaker arrangement portion 2. The auxiliary cover 14 is formed in, for example, a substantially hemispherical shape and attached to a portion of the speaker arrangement portion 2 where the cord insertion hole 4*b* is not formed. An air vent hole 14*a* is formed in the auxiliary cover 14. When the auxiliary cover 14 is attached to the speaker arrangement portion 2, the air existing between the speaker arrangement portion 2 and the auxiliary cover 14 is discharged from the air vent hole 14*a*, and good adhesion of the auxiliary cover 14 to the speaker arrangement portion 2 is secured.

By attaching the auxiliary cover 14 to the speaker arrangement portion 2, the gap between the abutting face 6*a* of the speaker arrangement portion 2 and the ear contact face 3*b* of the sound guiding pipe 3 is reduced by the thickness of the auxiliary cover 14, the auricle 101 is sandwiched between the speaker arrangement portion 2 and the sound guiding pipe 3 with sufficient pressure in a state where the sound output apparatus 1 is worn, and a stable wearing state of the sound output apparatus 1 on the ear 100 can be secured.

SUMMARY

As described above, the opening 11*b* that emits the sound toward the ear 100 is formed at the tip of the sound guiding pipe 3, and the sound output apparatus 1 is worn on the ear 100 in a state where the outer peripheral Portion of the auricle 101 is sandwiched between the respective parts of the speaker arrangement portion 2 and the sound guiding pipe 3.

Therefore, since the sound output apparatus 1 is worn on the ear 100 by sandwiching the outer peripheral portion of the auricle 101 between a part of the speaker arrangement portion 2 and a part of the sound guiding pipe 3, a stable wearing state on the ear 100 can be secured.

Particularly, it is unnecessary to hook a part of the sound output apparatus 1 on the root portion of the auricle 101, which is the boundary portion between the temporal region 201 and the auricle 101, to be worn so that the hair does not interfere with the sound output apparatus 1 for a long-haired user such as a woman, and a stable wearing state can be secured regardless of the length of hair of the user.

Moreover, even in a case where the user is wearing an accessory such as a pierced earring on the ear 100, the sound output apparatus 1 can be worn at a position other than the worn portion of the accessory, for example, the earlobe 112, and a stable wearing state can be secured while the usability is improved.

Note that the example, in which the sound output apparatus 1 is worn on the ear 100 in a state where the outer peripheral portion of the auricle 101 is sandwiched between the respective parts of the speaker arrangement Portion 2 and the sound guiding pipe 3, has been shown above, but the sound output apparatus 1 may be worn on the ear 100 in a state where the outer peripheral portion of the auricle 101 is sandwiched between the respective parts of the sound guiding pipe 3.

<Another Example of Sound Output Apparatus>

Hereinafter, sound output apparatuses 1A, 1B and 1C, which receive audio signals from an external device such as a music player by wireless communication, will be described.

Note that, since the sound output apparatuses 1A, 1B and 1C differ from the sound output apparatus 1 described above in that constituents arranged inside the speaker arrangement portion are different, only portions different from those of the sound output apparatus 1 will be described in detail, and other portions are denoted by reference signs the same as the reference signs denoting similar portions in the sound output apparatus 1 to omit the explanations thereof.

Figure 10:
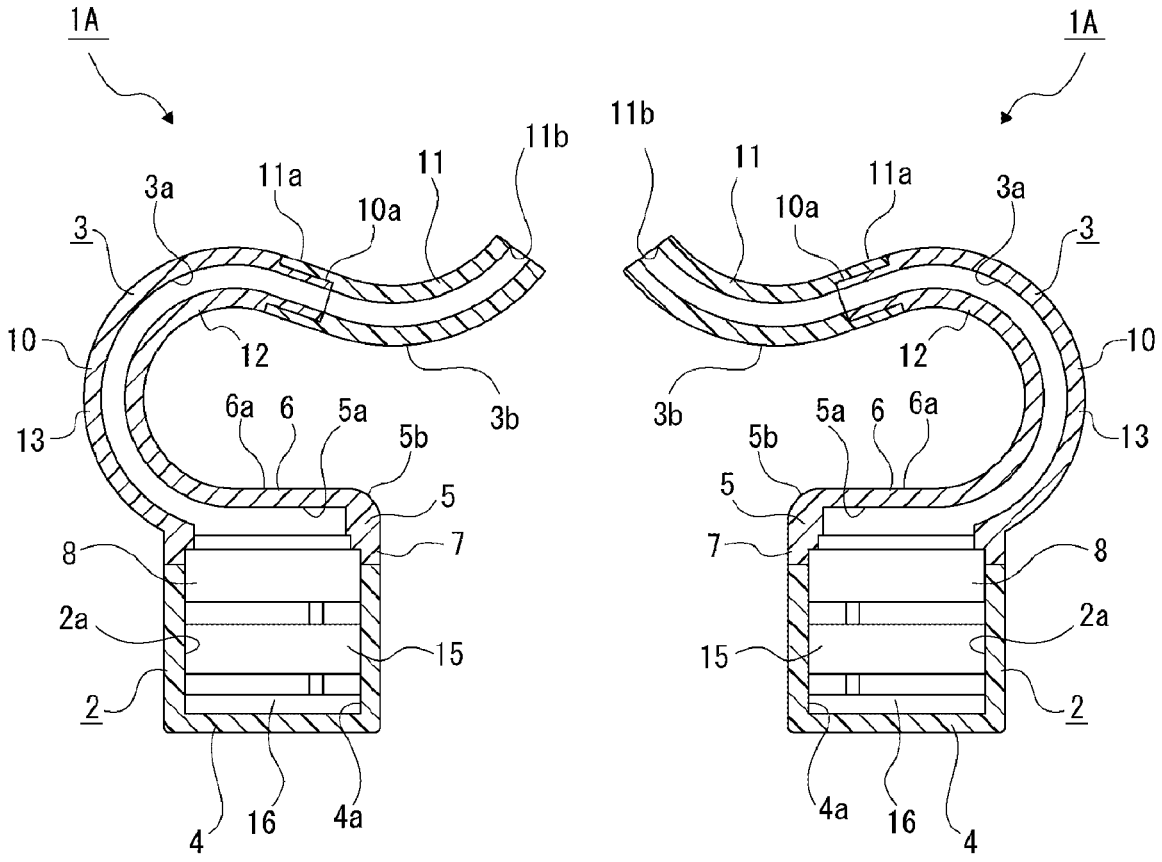
FIG. 10 is a sectional view showing another example of the sound output apparatus.

First, the sound output apparatus 1A will be described (see FIG. 10).

The sound output apparatus 1A for the left ear 100 and the sound output apparatus 1A for the right ear 100 are configured in a similar manner.

In the sound output apparatus 1A, a speaker 8 and a battery 13 are arranged inside a speaker arrangement Portion 2. The battery 15 may be of a disposable type or a chargeable type. Particularly, in a case where the battery 15 is of a disposable type, it is desirable that the speaker arrangement portion 2 is configured to be able to replace the battery 15 by making the part thereof able to be opened and closed. Moreover, in a case where the battery 15 is of a chargeable type, a part of the speaker arrangement portion 2 may also be able to be opened and closed so that the battery 15 can be replaced.

A control board 16 is arranged inside the speaker arrangement portion 2 together with the speaker 8 and the battery 15, and a driving circuit, which operates the speaker 8, and a communication circuit for wireless communication are formed on the control board 16. Therefore, the sound output apparatus 1A can receive an audio signal from an external device such as a music player, by wireless communication, convert the received audio signal to be outputted as the sound from the speaker 8, and perform pairing processing, such as connection authentication with the music player. The wireless communication for receiving the audio signal may be compatible with, for example, near field wireless communication such as Bluetooth (registered trademark), wireless fidelity (WiFi: registered trademark), or near field communication (NFC) as wireless communication for Pairing processing such as connection authentication.

The power of the battery 15 is supplied to the speaker 8 and the control board 16 to operate the speaker 8 and the control board 16.

In the sound output apparatus 1A, the audio signal is received by wireless communication of a communication circuit on the control board 16, and the received audio signal is sent to the speaker 8. The audio signal is converted into sound and outputted from the speaker 8.

Figure 11:
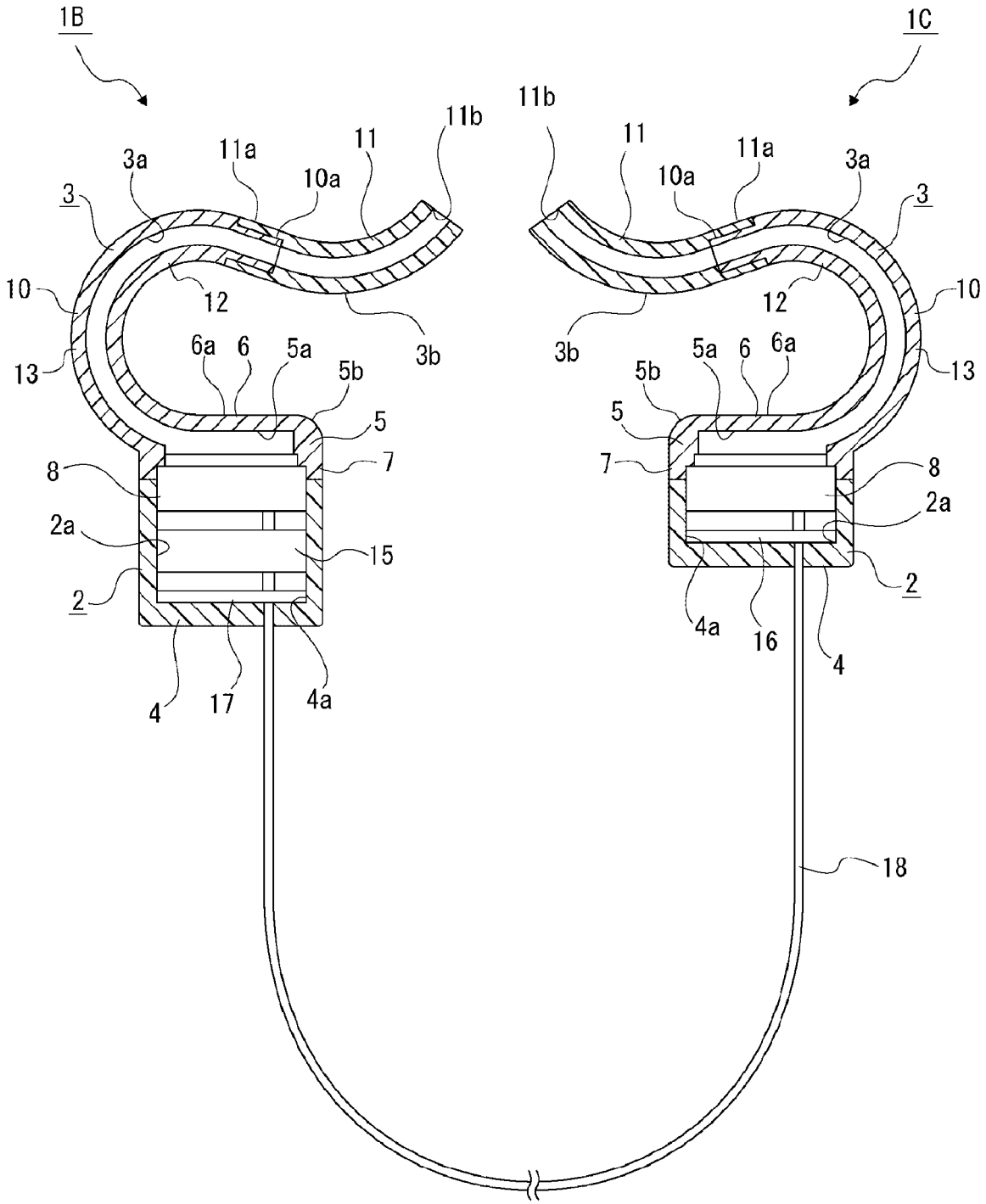
FIG. 11 is a sectional view showing still another example of the sound output apparatus.

Next, the sound output apparatus 1B and the sound output apparatus 1C will be described (see FIG. 11).

One of the sound output apparatus 1B and the sound output apparatus 1C is a sound output apparatus for the left ear 100, and the other is a sound output apparatus for the right ear 100. The sound output apparatus 1B and the sound output apparatus 1C are different in constituents arranged inside the speaker arrangement portions 2 and 2.

The speaker 8, the battery 15 and a relay board 17 are arranged inside the speaker arrangement portion 2 of the sound output apparatus 1B, and the speaker 8 and the control board 16 are arranged inside the speaker arrangement portion 2 of the sound output apparatus 1C.

The relay board 17 of the sound output apparatus 1B and the control board 16 of the sound output apparatus 1C are connected by a cable (cord) 18. The power of the battery 15 is supplied to the speaker 8 and the relay board 17 of the sound output apparatus 1B and also supplied to the control board 16 and the speaker 8 of the sound output apparatus 1C from the relay board 17 via the cable 18. Moreover, audio signals received by wireless communication of the communication circuit on the control board 16 are sent to the speaker 8 of the sound output apparatus 1C and also sent to the speaker 8 of the sound output apparatus 1B via the cable 18 and the relay board 17. The received audio signals are converted into sounds and outputted from the speakers 8 and 8, respectively.

As described above, since the audio signals are received by wireless communication in the sound output apparatuses 1A, 1B and 1C, there is no need of connection to the external device by the cord 9, and the convenience and usability can be improved.

Furthermore, as for the sound output apparatus 1A, since the connection wire such as the cord 9 is not connected, it is easy to carry and accommodate, and sagging of the connection wire does not occur when the sound output apparatus 1A is worn on the ear 100. Thus, it is possible to improve the portability and the accommodability when not used and to secure a good wearing state on the ear 100.

Further, as for the sound output apparatuses 1A and 1B, since the battery 13 is arranged in the speaker arrangement portion 2, there is no need of supplying power from the external device, and the usability can be improved.

In addition, as for the sound output apparatuses 1B and 1C, since the battery 15 is arranged only in one sound output apparatus 1B, it is possible to reduce the weight of the sound output apparatuses 1B and 1C as a whole as well as to simplify the internal structure.

Moreover, as for the sound output apparatus 1C, since the weight is reduced as described above, an excessive load is not applied to the ear 100 in a state of being worn on the ear 100, and a good wearing state can be secured without discomfort to the ear 100.

<Another Sound Output Apparatus and the Like>

Hereinafter, another sound output apparatus will described (see FIGS. 12 to 18).

One of another sound output apparatuses 71 and 71 is used for the left ear 100, and the other is used for the right ear 100. However, any one of the sound output apparatuses 71 may be used to hear to the sound.

The sound output apparatus 71 has a wear portion 72 and a speaker 73.

The wear portion 72 is formed in a bent shape such that the longitudinal direction becomes a circumferential direction, and is formed in a shape extending in the circumferential direction as a whole. The wear portion 72 has an outer face formed in a curved face that is convex outward.

The wear portion 72 is constituted by coupling a housing 74, a detachable body 75 and a connection member 76.

One end portion of the wear portion 72 in the longitudinal direction is provided as a speaker arrangement portion 77, the other end portion in the longitudinal direction is provided as a sound output portion 78, and a portion between the speaker arrangement portion 77 and the sound output portion 78 is provided as an intermediate portion 79.

The housing 74 is formed by using, for example, a resin material. A part of the housing 74 functions as the speaker arrangement portion 77, and the other portion functions as the intermediate portion 79. The housing 74 is constituted by coupling a first member 80 and a second member 81 (see FIGS. 13 to 15). The first member 80 and the second member 81 constitute the housing 74 by being coupled in a direction orthogonal to the longitudinal direction.

The first member 80 includes a base portion 82 formed in a substantially arc shape, an arrangement portion 83 continuous with one end of the base portion 82 in the longitudinal direction, and a joining portion 84 continuous with the other end of the base portion 82 in the longitudinal direction. A groove portion 82*a* extending in the longitudinal direction is formed at the base portion 82. An arrangement recessed portion 83*a* continuous with the groove portion 82*a* is formed at the arrangement portion 83. The joining portion 84 is formed in a cylindrical shape, and an internal space is formed as a sound hole 84*a* continuous with the groove portion 83*a*.

A shallow attachment recessed portion 83*b* is formed on the outer face side of the arrangement portion 83. A cord insertion hole 83*c*, which communicates with the attachment recessed portion 83*b* and the arrangement recessed portion 83*a*, is formed at the arrangement portion 83.

The second member 81 includes a base portion 85, which is formed in a substantially arc shape, and an arrangement portion 86, which is continuous with one end of the base portion 85 in the longitudinal direction. A groove portion 85*a* extending in the longitudinal direction is formed at the base portion 85. An arrangement recessed portion 86*a* continuous with the groove portion 85*a* is formed at the arrangement portion 86.

As for the first member 80 and the second member 81, for example, the base portion 82 and the base portion 85 are coupled as well as the arrangement portion 83 and the arrangement portion 86 are coupled by bonding. In a state where the first member 80 and the second member 81 are coupled, a sound guiding space 87 is formed by the groove portion 82*a* and the groove portion 85*a*, and an arrangement space 88 is formed by the arrangement recessed portion 83*a* and the arrangement recessed portion 86*a*.

In a state where the first member 80 and the second member 81 are coupled to constitute the housing 74, the speaker 73 is arranged at the arrangement space 88. As the speaker 73, for example, a dynamic type driver unit is used. Note that a battery for supplying power to the speaker 73, a control board which controls the speaker 73, and the like may be arranged at the arrangement space 88 in addition to the speaker 73.

Figure 15:
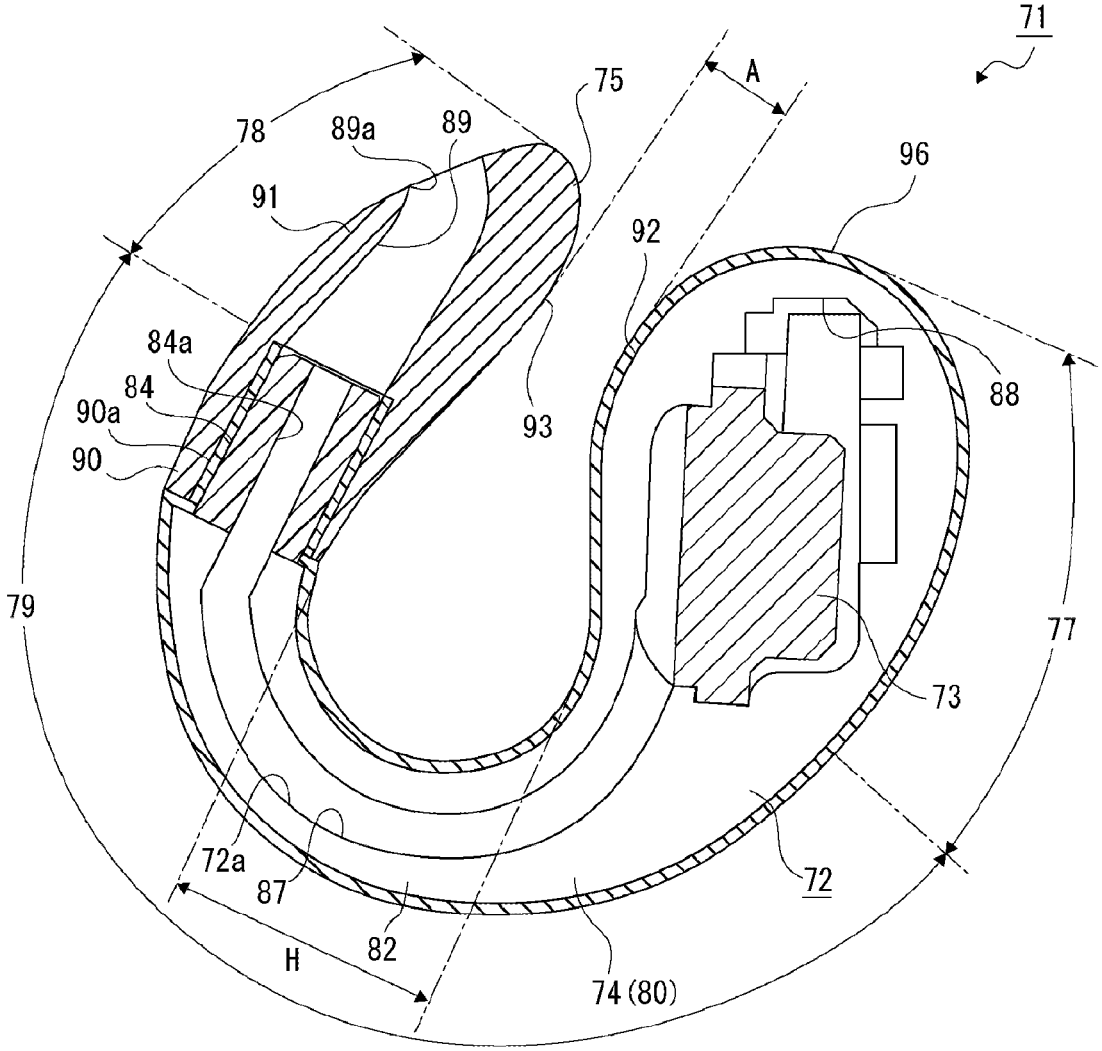
FIG. 15 is a sectional view of another sound output apparatus.
Figure 16:
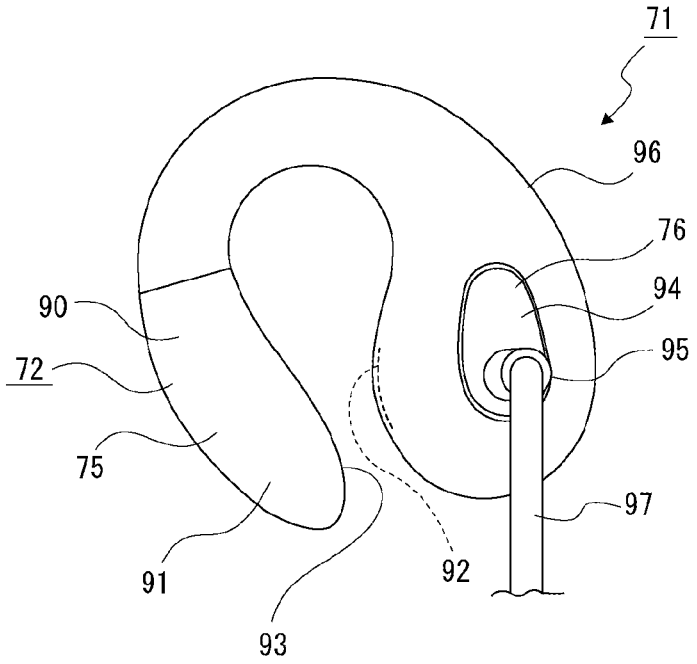
FIG. 16 is a side view showing a state before another sound output apparatus is elastically deformed.

The detachable body 75 is formed by using, for example, silicon or a rubber material, and a sound hole 89 is formed therein (see FIG. 15). One end of the sound hole 89 is formed as a sound output opening 89*a*. In the detachable body 75, the direction in which the sound hole 89 extends is the longitudinal direction, a substantially half portion in the longitudinal direction is provided as a coupling portion 90, and the other approximately half portion is provided as a tip portion 91. The coupling portion 90 functions as a part of the intermediate portion 79, and the tip portion 91 functions as the sound output portion 78.

In the detachable body 75, the inner peripheral portion of the coupling portion 90 is provided as an outer fitting portion 90*a*, and the outer fitting portion 90*a* is formed by using a material with hardness higher than that of the other portions of the detachable body 75. The detachable body 75 is detachable from the housing 74 and joins the housing 74 by externally fitting the outer fitting portion 90*a* to the joining portion 84.

The wear portion 72 is constituted in a state where the speaker arrangement portion 77 of the housing 74 and the tip portion 91 of the detachable body 75 are opposed. A portion of the speaker arrangement portion 77 opposing the tip portion 91 is provided as a first pressing portion 92. A portion of the tip portion 91 opposing the speaker arrangement portion 77 is provided as a second pressing portion 93. A gap A is formed between the first pressing portion 92 and the second pressing portion 93. The first pressing portion 92 and the second pressing portion 93 are portions which are pressed against both faces of the auricle 101 in a state where the sound output apparatus 71 is worn on the ear 100. The surfaces of the first pressing portion 92 and the second pressing portion 93 are formed as curved faces which is gently convex outward.

Moreover, a portion of the wear portion 72 other than both end portions in the longitudinal direction is provided as the intermediate portion 79, and the gap A between one ends in the longitudinal direction is shorter than the maximum distance H among the distances connecting the two points on the inner circumference of the intermediate portion 79.

The wear portion 72 is elastically deformable in a direction in which the first pressing portion 92 and the second pressing portion 93 are brought into or out of contact with each other.

Figure 12:
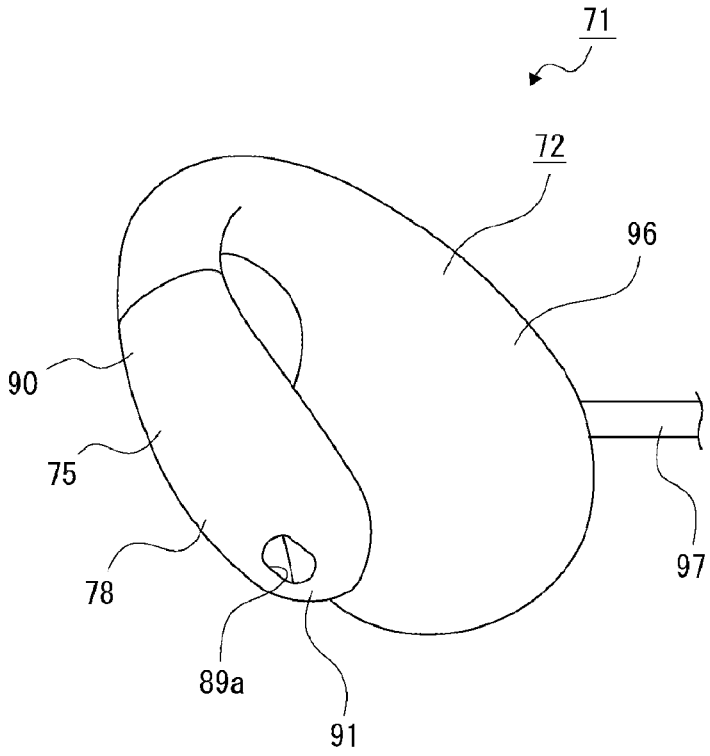
FIG. 12 is a perspective view of another sound output apparatus.
Figure 13:
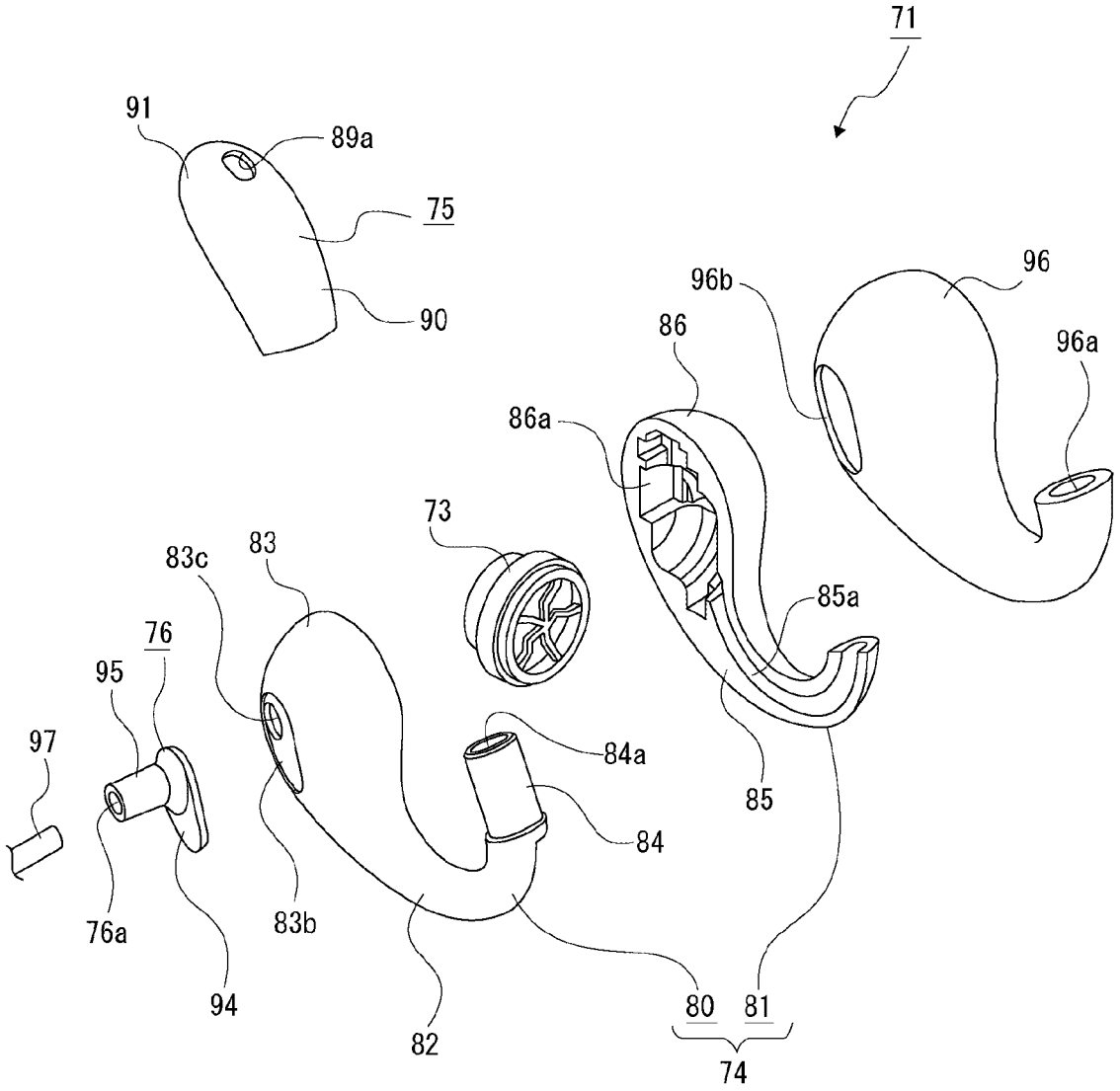
FIG. 13 is an exploded perspective view of another sound output apparatus.
Figure 14:
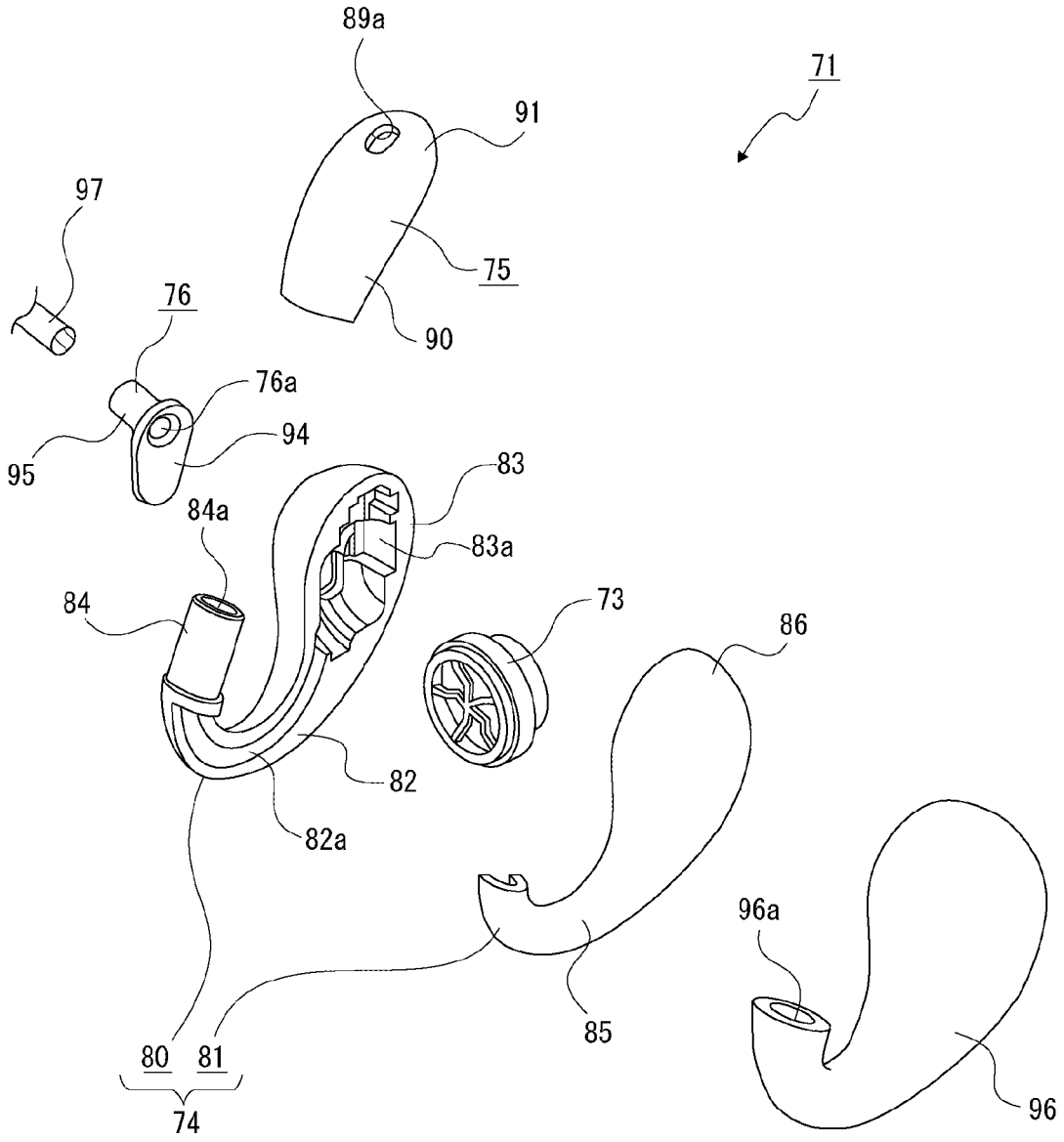
FIG. 14 is an exploded perspective view showing another sound output apparatus as seen from a direction different from that in FIG. 13.

The connection member 76 includes an attached plate Portion 94 and a cord insertion portion 95 projecting from the attached plate portion 94 (see FIGS. 12 to 14). At the connection member 76, a cord insertion hole 5*a* penetrating between the cord insertion portion 95 and the attached plate portion 94 is formed. The connection member 76 is attached to the housing 74 by bonding or the like in a state where the attached plate portion 94 is inserted into the attachment recessed portion 83*b*. In a state where the connection member 76 is attached to the housing 74, the cord insertion hole 5*a* communicates with the cord insertion hole 83*c*.

A portion of the housing 74 excluding the joining portion 84 is covered with a cover 96, and the cover 96 is closely attached to the outer face of the housing 74. The cover 96 is formed by using silicon or a rubber material, which are elastically deformable, and is formed in a bag shape with a reduced thickness. An opening portion 96*a* is formed on one end face of the cover 96. An arrangement hole 96*b* is formed at the cover 96.

In a state where the housing 74 is covered with the cover 96, the cover 96 is attached to the outer face of the housing 74, the opening portion 96*a* is positioned at the boundary portion between the joining portion 84 and the base portion 82, and the connection member 76 is arranged at the arrangement hole 96*b*. Therefore, the joining portion 84 of the housing 74 projects from the opening portion 96*a* and the cord insertion portion 95 of the connection member 76 projects from the arrangement hole 96*b*.

A cord 97 is inserted into the cord insertion hole 76*a* of the connection member 76 and the cord insertion hole 83*c* of the housing 74, and one end portion of the cord 97 is connected to the control board or the speaker 73. For example, a remote control apparatus (not shown) is connected to an intermediate portion of the cord 97 so that it is possible to change the type of sound outputted from the speaker 73, change the volume, and the like by manipulating the remote control apparatus.

Note that the cord 97 led out from the sound output apparatus 71 for the left ear 100 and the cord 97 led out from the sound output apparatus 71 for the right ear 100 both have the intermediate portions connected to the same remote control apparatus.

The other end portion of the cord 97 is connected to an external device (not shown), such as a music player, used as a generation source of sound (audio signal). Therefore, the audio signal outputted from the external device is transmitted to the speaker 73 via the cord 97, and the sound is outputted from the speaker 73. Moreover, power is supplied to the speaker 73 from the external device via the cord 97 so that the speaker 73 can be driven.

Similar to the sound output apparatus 1 and the like, the sound output apparatus 71 as described above is worn on the ear 100 in a state where the outer peripheral portion of the auricle 101, for example, the helix 102 is sandwiched from the front and the back.

Figure 17:
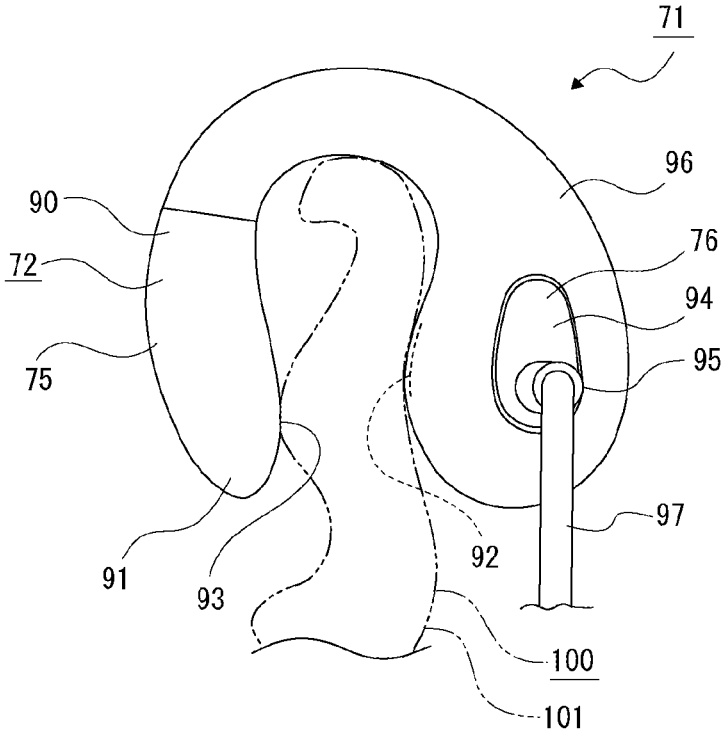
FIG. 17 is a side view showing a state where another sound output apparatus is worn.

When the sound output apparatus 71 is worn on the ear 100, the helix 102 is relatively inserted between the first pressing portion 92 and the second pressing portion 93 in a state where the first pressing portion 92 and the second pressing portion 93 are elastically deformed in a separation direction (see FIG. 16), and the sound output apparatus 71 is elastically restored and worn on the ear 100 in a state where the helix 102 is inserted (see FIG. 17). In a state where the sound output apparatus 71 is worn on the ear 100, the first pressing portion 92 and the second pressing portion 93 of the wear portion 72 are brought into a state where they are respectively in contact with and pressed against both faces of the auricle 101.

Note that the wear portion 72 is brought into a state where the first pressing portion 92 is pressed against and in contact with the auricle 101 via the cover 96 since the first pressing portion 92 is covered with the cover 96.

The first pressing portion 92 is brought in contact with the rear face of the auricle 101 and the second pressing portion 93 is in contact with the front face of the auricle 101. Therefore, the speaker 73 arranged at the speaker arrangement portion 77 is positioned on the rear side of the auricle 101.

Note that the example, in which the surfaces of the first pressing portion 92 and the second pressing portion 93 are formed in curved faces, has been shown above, but at least one of the surfaces of the first pressing portion 92 and the second pressing portion 93 may be formed to be planar.

Meanwhile, the detachment of the sound output apparatus 71 from the ear 100 can be performed by elastically deforming the sound output apparatus 71 in a direction in which the first pressing portion 92 and the second pressing portion 93 are separated and separating the sound output apparatus 71 from the auricle 101.

As described above, the wear portion 72 is formed in a bent shape such that the longitudinal direction becomes the circumferential direction, the gap A is formed between both ends in the longitudinal direction, and the wear portion 72 is elastically deformable in the direction in which both end portions in the longitudinal are brought into or out of contact with each other.

Therefore, since the wear portion 72 is elastically deformed when worn on or detached from the ear 100, the wear on and the detachment from the ear 100 can be easily performed as well as a stable wearing state on the ear 100 can be secured.

Moreover, since the first pressing portion 92 and the second pressing portion 93 are respectively provided at both end portions of the wear portion 72 in the sound output apparatus 71, both end portions of the wear portion 72 are respectively pressed against both faces of the auricle 101.

Therefore, the portions pressed against the auricle 101 become both end portions of the wear portion 72, the length from the first pressing portion 92 to the second pressing portion 93 becomes the entire length of the sound output apparatus 71 so that a stable wearing state on the ear 100 can be secured while the miniaturization of the sound output apparatus 71 is secured.

Furthermore, the portion of the wear portion 72 other than both end portions is provided as the intermediate portion 79, and the gap A between one ends in the longitudinal direction is shorter than the maximum distance H among the distances connecting the two points on the inner circumference of the intermediate portion 79.

Therefore, the intermediate portion 79 is hardly in contact with the auricle 101 in a state where the sound output apparatus 71 is worn on the ear 100, and the sound output apparatus 71 can be worn on the ear 100 without causing a load on the ear 100 from the intermediate portion 79.

Further, since the outer face of the wear portion 72 is formed in a curved face, the sound output apparatus 71 is worn on the ear 100 in a state where the curved face is pressed so that a good wearing state on the ear 100 can be secured.

In a state where the sound output apparatus 71 is worn on the ear 100 as described above, the detachable body 75 is positioned at the inner space 150 of the auricle 101 in a state where the tip portion is in non-contact with the auricle 101. The detachable body 75 is brought into a state not closing the entire external auditory pore 113*a*, and the opening 89*a* is positioned near the external auditory pore 113*a*.

Note that the detachable body 75 having the opening 89*a* is detachable from the joining portion 84 of the housing 74. Therefore, the detachable body 75 can be replaced according to the size, shape and the like of the ear 100, and it is possible to secure a good hearing state of the sound regardless of the size, shape and the like of the ear 100.

For example, by replacing the detachable body 75 with one with a different length, the opening 89*a* can be positioned at a desired position in a state where the sound output apparatus 71 is worn on the ear 100, and the usability of the sound output apparatus 71 can be improved.

Moreover, since the joining portion 84 inserted into the detachable body 75 upon joining the detachable body 75 is provided in the sound output apparatus 71, the detachable body 75 joins the joining portion 84 by inserting the inserting the joining portion 84 into the detachable body 75 so that it is possible to quickly and easily perform the joining work of the detachable body 75 to the joining portion 84.

Furthermore, by attaching the cover 96 to the wear portion 72, the gap between the cover 96 and the second pressing portion 93 becomes shorter than the gap A by the thickness of the cover 96, the auricle 101 is sandwiched between the first pressing portion 92 and the second pressing portion 93 with sufficient pressure in a state where the sound output apparatus 71 is worn, and a stable wearing state of the sound output apparatus 71 on the ear 100 can be secured.

Note that the detachable body 75 may be formed by using a material (flexible material) which is capable of being deformed (bent) and maintains the deformed state. By making the detachable body 75 of such a material, it is possible to, in a state where the sound output apparatus 71 is worn on the ear 100, deform the detachable body 75 into a desired state, for example, to make the opening 89*a* close to the external auditory canal 113 and change the direction of the sound emitted from the opening 89*a* as necessary.

Further, both of the joining portion 84 and the detachable body 75 may be formed by using a material which is capable of being deformed (bent) and maintains the deformed states. By making the joining portion 84 and the detachable body 75 of such a material, it is possible to, in a state where the sound output apparatus 71 is worn on the ear 100, deform the wear portion 72 into a desired state, for example, to make the opening 89*a* close to the external auditory canal 113 and change the direction of the sound emitted from the opening 89*a* as necessary.

Moreover, when the wear portion 72 is worn on the ear 100, the wear portion 72 can be deformed according to the shape and size of the ear 100 so that a stable wearing state of the sound output apparatus 71 on the ear 100 can be secured.

Figure 18:
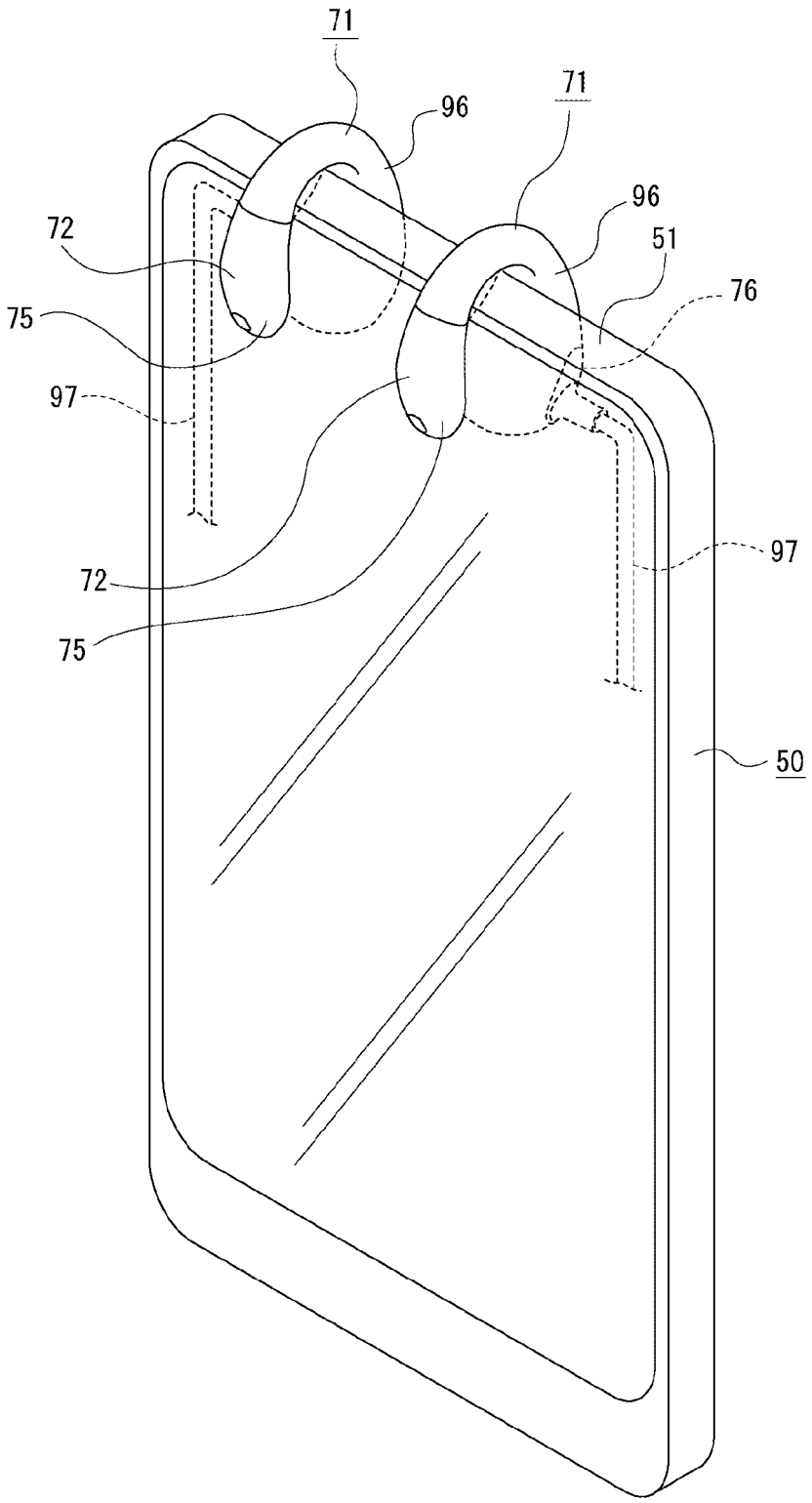
FIG. 18 is a perspective view showing a state where another sound output apparatuses are attached to an electronic device.
Figure 19:
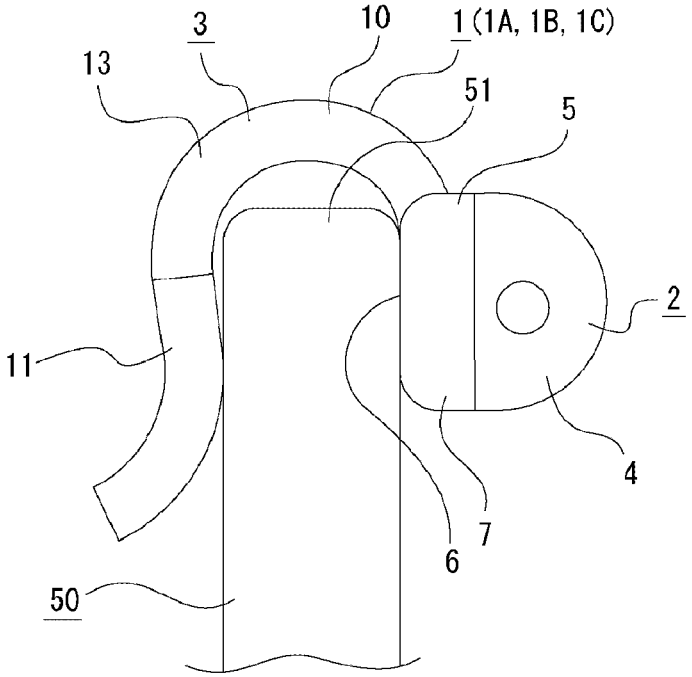
FIG. 19 is a side view showing a state where the sound output apparatus is attached to the electronic device.

The sound output apparatuses 71 and 71 can also be attached to other structural objects, devices and the like for storage and the like (see FIG. 18).

For example, in a case where the sound output apparatus 71 is used in an electronic device 50 such as a mobile phone, or the like, an outer peripheral portion 51 of the electronic device 50 is inserted between the speaker arrangement portion 77 and the sound output portion 78, and the sound output apparatus 71 can be attached to the electronic device 50 for storage and the like in a state where the outer peripheral portion 51 is sandwiched between the speaker arrangement portion 77 and the sound output portion 78 from both face sides. In a state where the outer peripheral portion 51 is sandwiched between the speaker arrangement portion 77 and the sound output portion 78 from both face sides, an urging force is applied by the elastic force to the sound output apparatus 71 in the direction in which the speaker arrangement portion 77 and the sound output portion 78 approach each other, and the sound output apparatus 71 is brought into a state of hardly falling off from the electronic device 50 by vibration or the like.

Such use (storage) can also be performed, for example, when listening to music is temporarily stopped and the sound output apparatus 71 is detached from the ear 100, and the like.

Since the sound output apparatus 71 is elastically deformed in a direction in which the first pressing portion 22 and the second pressing portion 23 are brought into or out of contact with each other, the wear portion 2 is elastically deformed when worn on or detached from the ear 100 so that the wear on and the detachment from the ear 100 can be easily performed as well as a stable wearing state on the ear 100 can be secured.

Furthermore, since the wear portion 2 bent such that the longitudinal direction becomes the circumferential direction is provided, and the first pressing portion 22 and the second pressing portion 23 are provided at both end portions of the wear portion 2 in the longitudinal direction, both end portions of the wear portion 2 are respectively pressed against both faces of the auricle 101 in a state of being elastically deformed so that a stable wearing state on the ear 100 can be secured.

Note that, similar to the sound output apparatus 71, also in the sound output apparatuses 1, 1A, 1B and 1C described above, for example, in a case where the sound output apparatus 1, 1A, 1B or 1C is used in the electronic device 50 such as a mobile phone, or the like, the outer peripheral portion 51 of the electronic device 50 is inserted between the speaker arrangement portion 2 and the sound guiding pipe 3, and the sound output apparatus 1, 1A, 1B or 1C can be attached to the electronic device 50 for storage and the like in a state where the outer peripheral portion 51 is sandwiched between the speaker arrangement portion 2 and the sound guiding pipe 3 from both face sides. In a state where the outer peripheral portion 51 is sandwiched between the speaker arrangement portion 2 and the sound guiding pipe 3 from both face sides, an urging force can also be applied by the elastic force to the sound output apparatus 71 in the direction in which the speaker arrangement portion 2 and the sound guiding pipe 3 approach each other. In this case, in particular, the sound output apparatus 1, 1A, 1B or 1C is brought into a state of hardly falling off from the electronic device 50 by vibration or the like.

As described above, since the sound output apparatus 1, 1A, 1B, 1C or 71 can be attached to the outer peripheral portion 51, for example, in a state where the outer peripheral portion 51 of the electronic device 50 such as a mobile phone is sandwiched, the portability, storage and the like are facilitated, and the usability can be improved.

Further, at the time of carrying or storing, it is possible to prevent entanglement between the cords 97 and 97 and the speaker arrangement portion 2, the sound guiding pipe 3 and the wear portion 72, which are portions worn on the ear 100, and between the cords 97 and 97 to each other to improve the usability.

<Present Technology>

Note that the present technology can adopt the following configurations.

(1)

A sound output apparatus including:

a speaker that outputs sound;

a speaker arrangement portion in which the speaker is arranged therein; and a sound guiding pipe in which one end portion is continuous with the speaker arrangement portion and an internal space is formed as a sound guiding space that leads the sound outputted from the speaker, in which an opening that emits the sound toward an ear is formed at the other end of the sound guiding pipe, and the sound output apparatus is worn on the ear in a state where an outer peripheral portion of an auricle is sandwiched between a part of the speaker arrangement portion and a part of the sound guiding pipe or between respective parts of the sound guiding pipe.

(2)

The sound output apparatus according to (1), in which the opening is positioned at an inner space of the auricle.

(3)

The sound output apparatus according to (2), in which the opening is positioned at a cavum concha.

(4)

The sound output apparatus according to any one of (1) to (3), in which the part of the sound guiding pipe is formed as an ear contact face in contact with the auricle, and the ear contact face is formed in a curved shape.

(5)

The sound output apparatus according to any one of (1) to (4), in which the part of the speaker arrangement portion is formed as an abutting face that can be in contact with the auricle, and the abutting face is formed in a planar shape.

(6)

The sound output apparatus according to any one of (1) to (5), in which the sound guiding pipe is provided with a coupling base portion, which is continuous with the speaker arrangement portion, and a detachable portion, which is detachable from the coupling base portion and has the opening.

(7)

The sound output apparatus according to (6), in which the coupling base portion is provided with an entry portion that enters the detachable portion when the detachable portion is attached to the coupling base portion.

(8)

The sound output apparatus according to (6) or (7), in which the detachable portion is formed by using a material with hardness lower than that of the coupling base portion.

(9)

The sound output apparatus according to any one of (1) to (8), in which the sound guiding pipe is elastically deformable against the speaker arrangement portion.

(10)

The sound output apparatus according to any one of (1) to (9), in which a tip portion of the sound guiding pipe is in a state of being non-contact with the ear in a state of being worn on the ear.

(11)

The sound output apparatus according to any one of (1) to (10), in which at least a part of the speaker arrangement portion and at least a part of the sound guiding pipe are integrally formed.

(12)

The sound output apparatus according to any one of (1) to (11), in which a pair of the speaker arrangement portions, a pair of the sound guiding pipes and a pair of the speakers are provided.

(13)

The sound output apparatus according to any one of (1) to (12), in which a battery that supplies power to the speaker is arranged at the speaker arrangement portion.

(14)

The sound output apparatus according to any one of (1) to (13), in which a control board for wireless communication is arranged at the speaker arrangement portion.

(15)

The sound output apparatus according to any one of (1) to (14), in which a first pressing portion and a second pressing portion, which are respectively pressed against both faces of the auricle, are provided, and the first pressing portion and the second pressing portion are elastically deformable in a direction in which the first pressing portion and the second pressing portion are brought into or out of contact with each other.

(16)

The sound output apparatus according to (15), in which a wear portion, which is bent such that a longitudinal direction becomes a circumferential direction, is provided, and the first pressing portion and the second pressing Portion are provided at both end portions of the wear portion in the longitudinal direction.

REFERENCE SIGNS LIST

100 Ear
101 Auricle
150 Inner space
114 Cavum concha
1 Sound output apparatus
2 Speaker arrangement portion
3 Sound guiding pipe
3*a* Sound guiding space
3*b* Ear contact face
6*a* Abutting face
8 Speaker
10 Coupling base portion
10*a* Entry portion
11 Detachable portion
11*b* Opening
1A Sound output apparatus
1B Sound output apparatus

71 Sound output apparatus
72 Wear portion
92 First pressing portion
93 Second pressing portion

What is claimed is:

1. A sound output apparatus comprising:

a speaker that outputs sound;

a speaker arrangement portion in which the speaker is arranged therein; and a sound guiding pipe in which one end portion is continuous with the speaker arrangement portion and an internal space is formed as a sound guiding space that leads the sound outputted from the speaker, wherein an opening that emits the sound toward an ear is formed at another end of the sound guiding pipe, and the sound output apparatus is worn on the ear in a state where an outer peripheral portion of an auricle is sandwiched between a part of the speaker arrangement portion and a part of the sound guiding pipe such that the opening is positioned near an external auditory canal and does not come in contact with the ear, wherein a tip portion of the sound guiding pipe is also not in contact with the ear.

2. The sound output apparatus according to claim 1, wherein the part of the sound guiding pipe is formed as an ear contact face in contact with the auricle, and the ear contact face is formed in a curved shape.

3. The sound output apparatus according to claim 1, wherein the part of the speaker arrangement portion is formed as an abutting face that can be in contact with the auricle, and the abutting face is formed in a planar shape.

4. The sound output apparatus according to claim 1, wherein the sound guiding pipe is provided with a coupling base portion, which is continuous with the speaker arrangement portion, and a detachable portion, which is detachable from the coupling base portion and has the opening.

5. The sound output apparatus according to claim 4, wherein the coupling base portion is provided with an entry portion that enters the detachable portion when the detachable portion is attached to the coupling base portion.

6. The sound output apparatus according to claim 4, wherein the detachable portion is formed by using a material with a hardness lower than that of the coupling base portion.

7. The sound output apparatus according to claim 1, wherein the sound guiding pipe is elastically deformable against the speaker arrangement portion.

8. The sound output apparatus according to claim 1, wherein at least a part of the speaker arrangement portion and at least a part of the sound guiding pipe are integrally formed.

9. The sound output apparatus according to claim 1, wherein a pair of the speaker arrangement portions, a pair of the sound guiding pipes and a pair of the speakers are provided.

10. The sound output apparatus according to claim 1, wherein a battery that supplies power to the speaker is arranged in the speaker arrangement portion.

11. The sound output apparatus according to claim 1, wherein a control board for wireless communication is arranged in the speaker arrangement portion.

12. The sound output apparatus according to claim 1, wherein a first pressing portion and a second pressing portion, which are respectively pressed against both faces of the auricle, are provided, and the first pressing portion and the second pressing portion are elastically deformable in a direction in which the first pressing portion and the second pressing portion are brought into or out of contact with each other.

13. The sound output apparatus according to claim 12, wherein a wear portion, which is bent such that a longitudinal direction becomes a circumferential direction, is provided, and the first pressing portion and the second pressing portion are provided at both end portions of the wear portion in the longitudinal direction.

* * * * *